US011647882B2

(12) United States Patent
Cho et al.

(10) Patent No.: US 11,647,882 B2
(45) Date of Patent: May 16, 2023

(54) DUST COLLECTING APPARATUS AND CLEANER HAVING THE SAME

(71) Applicant: Samsung Electronics Co., Ltd., Suwon-si (KR)

(72) Inventors: Dongjin Cho, Suwon-si (KR); Hyeonwoo Tak, Suwon-si (KR); Jiwook Chung, Suwon-si (KR); Jiho Seo, Suwon-si (KR); Wonkyu Lim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 121 days.

(21) Appl. No.: 16/813,063

(22) Filed: Mar. 9, 2020

(65) Prior Publication Data

US 2020/0281429 A1 Sep. 10, 2020

(30) Foreign Application Priority Data

Mar. 8, 2019 (KR) ..... 10-2019-0027154
Nov. 28, 2019 (KR) ..... 10-2019-0154979

(51) Int. Cl.
*A47L 9/14* (2006.01)
*A47L 9/28* (2006.01)
(Continued)

(52) U.S. Cl.
CPC ..... *A47L 9/149* (2013.01); *A47L 5/225* (2013.01); *A47L 5/24* (2013.01); *A47L 5/34* (2013.01);
(Continued)

(58) Field of Classification Search
CPC . A47L 9/149; A47L 9/02; A47L 9/102; A47L 9/106; A47L 9/12; A47L 9/1683;
(Continued)

(56) References Cited

U.S. PATENT DOCUMENTS 4,209,875 A * 7/1980 Pugh ..... A47L 5/24 D32/18
10,966,583 B2 * 4/2021 Conrad ..... A47L 9/1683
(Continued)

FOREIGN PATENT DOCUMENTS

AU 2017 314 625 A1 1/2019
CN 103584800 A 2/2014
(Continued)

OTHER PUBLICATIONS

International Search Report dated Jun. 30, 2020, issued in International Application No. PCT/KR2020/002822.
(Continued)

*Primary Examiner* — David Redding
*Assistant Examiner* — Michael A Gump
(74) *Attorney, Agent, or Firm* — Jefferson IP Law, LLP

(57) ABSTRACT

A cleaner is provided. The cleaner includes a transfer device, and a dust collecting apparatus connectable to the transfer device and configured to filter out rubbish transferred from the transfer device. The dust collecting apparatus includes a housing in which a first dust chamber is formed, and including a guide recessed inwardly from an outer surface, a handle configured to be movable on the outside of the housing and provided to cover at least a portion of the guide, a first rubbish removal member configured to be movable inside the housing based on the movement of the handle, and configured to discharge rubbish collected in the first dust chamber, and a link configured to connect the handle to the first rubbish removal member, and having a movement guided by the guide.

14 Claims, 16 Drawing Sheets

(51) Int. Cl.

| | |
|---|---|
| ***A47L 9/10*** | (2006.01) |
| ***A47L 9/16*** | (2006.01) |
| ***A47L 9/32*** | (2006.01) |
| ***A47L 9/22*** | (2006.01) |
| ***A47L 5/24*** | (2006.01) |
| ***A47L 5/34*** | (2006.01) |
| ***A47L 9/02*** | (2006.01) |
| ***A47L 9/12*** | (2006.01) |
| ***A47L 5/22*** | (2006.01) |

(52) U.S. Cl.
CPC ..... *A47L 9/02* (2013.01); *A47L 9/102* (2013.01); *A47L 9/106* (2013.01); *A47L 9/12* (2013.01); *A47L 9/1683* (2013.01); *A47L 9/22* (2013.01); *A47L 9/2884* (2013.01); *A47L 9/322* (2013.01)

(58) Field of Classification Search
CPC ..... A47L 9/22; A47L 9/2884; A47L 9/322; A47L 9/04; A47L 9/1625; A47L 9/1633; A47L 9/1666; A47L 9/325; A47L 9/104; A47L 9/20; A47L 5/225; A47L 5/24; A47L 5/34; A47L 5/26
USPC ..... 15/329
See application file for complete search history.

(56) References Cited

U.S. PATENT DOCUMENTS

| | | | | |
|---|---|---|---|---|
| 11,191,406 | B2 * | 12/2021 | Cho | A47L 9/322 |
| 2001/0025395 | A1 * | 10/2001 | Matsumoto | A47L 9/1683 15/353 |
| 2004/0187253 | A1 * | 9/2004 | Jin | A47L 9/20 15/352 |
| 2014/0215751 | A1 * | 8/2014 | Kasper | A47L 9/104 15/347 |
| 2014/0237761 | A1 * | 8/2014 | Holz | A47L 9/1683 15/347 |
| 2016/0287042 | A1 * | 10/2016 | Han | A47L 9/20 |
| 2017/0079490 | A1 * | 3/2017 | Dimbylow | A47L 5/28 |
| 2017/0112341 | A1 * | 4/2017 | Han | B04C 5/22 |
| 2018/0368639 | A1 | 12/2018 | Peters et al. | |
| 2019/0183301 | A1 * | 6/2019 | Hwang | A47L 9/2857 |

FOREIGN PATENT DOCUMENTS

| | | | | | |
|---|---|---|---|---|---|
| CN | 104622390 | A | | 5/2015 | |
| CN | 207666537 | U | | 7/2018 | |
| CN | 207768308 | U | | 8/2018 | |
| CN | 108903789 | A | | 11/2018 | |
| CN | 109394081 | A | | 3/2019 | |
| JP | S57-048849 | U | | 3/1982 | |
| JP | 2009-172214 | A | | 8/2009 | |
| JP | 2009-268564 | A | | 11/2009 | |
| JP | 2009268564 | A | * | 11/2009 | |
| JP | 4901552 | B2 | | 3/2012 | |
| KR | 10-2018-0023790 | A | | 3/2018 | |
| KR | 10-2019-0066239 | A | | 6/2019 | |
| WO | WO-2016206758 | A1 | * | 12/2016 | A47L 9/1427 |

OTHER PUBLICATIONS

European Search Report dated Nov. 8, 2021; European Application No. 20768992.8-1016 / 3849390PCT/KR2020002822.
Chinese Office Action with English translation dated Jun. 23, 2022; Chinese Appln. No. 202080007166.X.

* cited by examiner

DUST COLLECTING APPARATUS AND CLEANER HAVING THE SAME

CROSS-REFERENCE TO RELATED APPLICATION(S)

This application is based on and claims priority under 35 U.S.C. § 119 of a Korean patent application number 10-2019-0027154, filed on Mar. 8, 2019, in the Korean Intellectual Property Office, and a Korean patent application number 10-2019-0154979, filed on Nov. 28, 2019, in the Korean Intellectual Property Office, the disclosure of each of which is incorporated by reference herein in its entirety.

BACKGROUND

1. Field

The disclosure relates to a dust collecting apparatus and a cleaner having the same. More particularly, the disclosure relates to a dust collecting apparatus having an improved structure and a cleaner having the same.

2. Description of Related Art

A cleaner is a device that removes rubbish and cleans indoors, and a vacuum cleaner is generally used at home. The vacuum cleaner suctions air using the suction power of a fan motor unit and separates rubbish from the suctioned air with a device such as a filter, thereby cleaning the room. The vacuum cleaner is classified into the canister type and the upright type. In recent years, a robot cleaner has been popular, and the robot cleaner can travel a region to be cleaned and suction rubbish such as dust from the region, thereby performing the cleaning operation by itself without user operation.

In order to filter out the rubbish contained in the suctioned air, the vacuum cleaner includes a dust collecting apparatus therein to filter out the rubbish by a predetermined filtering device. The filtering device for filtering out the rubbish in the dust collecting apparatus includes a porous filter unit in which air is passed through the porous filter, and the rubbish is forcedly filtered out, and a cyclone dust collecting apparatus for filtering out rubbish during cyclone flow of air.

As for the vacuum cleaner, the rubbish such as human hair or animal hair is tangled to the dust collecting apparatus during the rubbish is filtered out, and thus a user should manually separate the rubbish from the dust collecting apparatus, which causes the unsanitary and difficulty for the use of the vacuum cleaner.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is to provide a cleaner capable of easily discharging rubbish collected in a dust collecting apparatus from a dust chamber.

Another aspect of the disclosure is to provide a cleaner capable of preventing rubbish from scattering upon emptying a dust chamber.

Another aspect of the disclosure is to provide a cleaner having a reduced size.

Another aspect of the disclosure is to provide a cleaner capable of having an improved user convenience.

Another aspect of the disclosure is to provide a cleaner capable of preventing a dust chamber from being inadvertently opened.

Additional aspects will be set forth in part in the description which follows and, in part, will be apparent from the description, or may be learned by practice of the presented embodiments.

In accordance with an aspect of the disclosure, a cleaner is provided. The cleaner includes a suction head, a dust collecting apparatus having one end mounted on the suction head, and configured to form a dust chamber, and an extension member slidably mounted on the dust collecting apparatus. The extension member includes a rubbish removal member configured to be slidable in the dust chamber and configured to discharge rubbish of the dust chamber, and an opening and closing device configured to open and close the dust chamber and configured to interlock with the rubbish removal member, wherein the opening and closing device is an opening and closing frame.

The opening and closing device may include an opening and closing member, in which a chamber inlet is formed, and an opening and closing cover configured to open and close the chamber inlet by a suction force formed in the dust chamber.

One portion of the opening and closing cover may be fixed to the opening and closing member, and another portion different from the one portion may be deformable by the suction force formed in the dust chamber.

The opening and closing device may include an opening and closing sealing member configured to seal between the dust collecting apparatus and the opening and closing member.

The opening and closing sealing member may be arranged along an edge of the opening and closing member, and the opening and closing sealing member may be formed to include a more flexible material than the opening and closing member.

The extension member may include a connection portion configured to connect the rubbish removal member to the opening and closing device, and a discharge opening formed between the rubbish removal member and the opening and closing device and configured to discharge rubbish of the dust chamber.

The opening and closing device may move away from the dust collecting apparatus to open the dust chamber when the rubbish removal member slides to be moved out of the dust chamber, and the opening and closing device may move closer to the dust collecting apparatus to close the dust chamber when the rubbish removal member slides to be inserted into the dust chamber.

The extension member may include a handle arranged at an end opposite to one end of the extension member in which the opening and closing device is arranged, and a fan motor unit configured to generate a suction force for the dust chamber and arranged closer to the opening and closing device than the handle.

The cleaner may further include a battery arranged between the handle and the fan motor unit of the extension member.

The dust collecting apparatus may include a discharge port formed at a portion of a rear surface thereof corresponding to the position of the fan motor unit in a state in which the opening and closing device closes the dust chamber.

The cleaner further includes a motor filter configured to filter air introduced to the fan motor unit, the motor filter may be arranged between the fan motor unit and the dust chamber.

The dust collecting apparatus may include a filtering device arranged in the dust chamber and configured to filter out rubbish introduced through the suction head, and when the extension member slides with respect to the dust collecting apparatus, the rubbish removal member may be slidable in one surface of the filtering device on which the filtered out rubbish is placed.

The dust chamber may be a first dust chamber, the extension member may include a cyclone configured to remove rubbish from air passing through the first dust chamber, and the dust collecting apparatus may include a second dust chamber in which rubbish separated by the cyclone is collected.

The rubbish removal member may be a first rubbish removal member, and the extension member may include a second rubbish removal member configured to be slidable in the second dust chamber and the first dust chamber to discharge rubbish of the second dust chamber based on a sliding movement of the extension member with respect to the dust collecting apparatus.

In accordance with another aspect of the disclosure, a cleaner is provided. The cleaner includes a transfer device, and a dust collecting apparatus connectable to the transfer device and configured to filter out rubbish transferred from the transfer device. The dust collecting apparatus includes a housing in which a first dust chamber is formed, and including a guide recessed inwardly from an outer surface, a handle configured to be movable on the outside of the housing and provided to cover at least a portion of the guide, a first rubbish removal member configured to be movable inside the housing based on a movement of the handle, and configured to discharge rubbish collected in the first dust chamber, and a link configured to connect the handle to the first rubbish removal member, and having a movement guided by the guide.

The dust collecting apparatus may include a filtering device configured to filter out the rubbish received from the transfer device, and arranged in the first dust chamber.

The first rubbish removal member may include a first contact portion in close contact with an inner surface of the filtering device and formed to include a flexible material.

The dust collecting apparatus may include a rubbish separator arranged at a rear of the filtering device in a direction in which air introduced from the transfer device is discharged, and the rubbish separator is configured to filter out rubbish passing through the filtering device.

The dust collecting apparatus may include a filter member arranged at the rear of the rubbish separator in a direction in which air introduced from the transfer device is discharged, and configured to filter out rubbish passing through the rubbish separator.

The dust collecting apparatus may include a fan motor unit arranged at the rear of the filter member in a direction in which air introduced from the transfer device is discharged, and configured to generate a suction force.

The rubbish separator may include at least one cyclone.

The dust collecting apparatus may include a second dust chamber formed in the housing to collect rubbish that is filtered out by the rubbish separator.

The dust collecting apparatus may include a second rubbish removal member configured to be movable in the housing based on the movement of the handle and configured to discharge rubbish collected in the second dust chamber.

The second rubbish removal member may be arranged on one portion of the link between the first rubbish removal member and the handle and particularly arranged between the second dust chamber and the rubbish separator.

The second rubbish removal member may include a second contact portion in close contact with an inner surface of the second dust chamber and formed to include a flexible material.

The first rubbish removal member may be movable between a first position between the first dust chamber and the second dust chamber and a second position protruding to the outside of the housing.

The dust collecting apparatus may include a link sealing member configured to seal one portion of the housing in which the inside and the outside of the housing communicate with each other and to which the link is movably inserted.

The dust collecting apparatus may include a cover configured to open and close one portion of the housing in which the filter member is arranged.

The handle may be configured to cover one portion of the outer surface of the housing so as to be slidable along the outer surface of the housing, and the guide may extend along a direction in which the handle slides.

In accordance with another aspect of the disclosure, a dust collecting apparatus is provided. The dust collecting apparatus includes a housing in which a first dust chamber and a second dust chamber are formed, and including a guide recessed inwardly from an outer surface, a handle configured to be movable on the outside of the housing and provided to cover at least a portion of the guide, a first rubbish removal member configured to interlock with the handle and configured to be movable between a first position between the first dust chamber and the second dust chamber and a second position protruding to the outside of the housing, a second rubbish removal member configured to interlock with the handle and arranged with the first rubbish removal member to form the second dust chamber, and a link configured to connect the handle, the first rubbish removal member and the second rubbish chamber, and having a movement guided by the guide.

The dust collecting apparatus may further include a filtering device arranged in the first dust chamber and configured to filter out rubbish.

The dust collecting apparatus may further include a rubbish separator arranged at the rear of the filtering device and configured to filter out rubbish passing through the filtering device.

The dust collecting apparatus may further include a filter member arranged at the rear of the rubbish separator and configured to filter out rubbish passing through the rubbish separator.

In accordance with another aspect of the disclosure, a cleaner is provided. The cleaner includes a transfer device, and a dust collecting apparatus connectable to the transfer device. The dust collecting apparatus includes a filtering device configured to filter out rubbish transferred from the transfer device, a housing configured to form a dust chamber in which rubbish filtered out by the filtering device is collected, a rubbish separator arranged at the rear of the filtering device and configured to filter out rubbish passing through the filtering device, a filter member arranged at the rear of the rubbish separator and configured to filter out rubbish passing through the rubbish separator, a fan motor unit arranged at the rear of the filter member and configured to generate a suction force, and a rubbish remover including a handle configured to be movable on the outside of the housing and a rubbish removal member configured to be movable in the inside of the housing and configured to discharge rubbish collected in the dust chamber to the outside of the housing based on the movement of the handle.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

Figure 1:
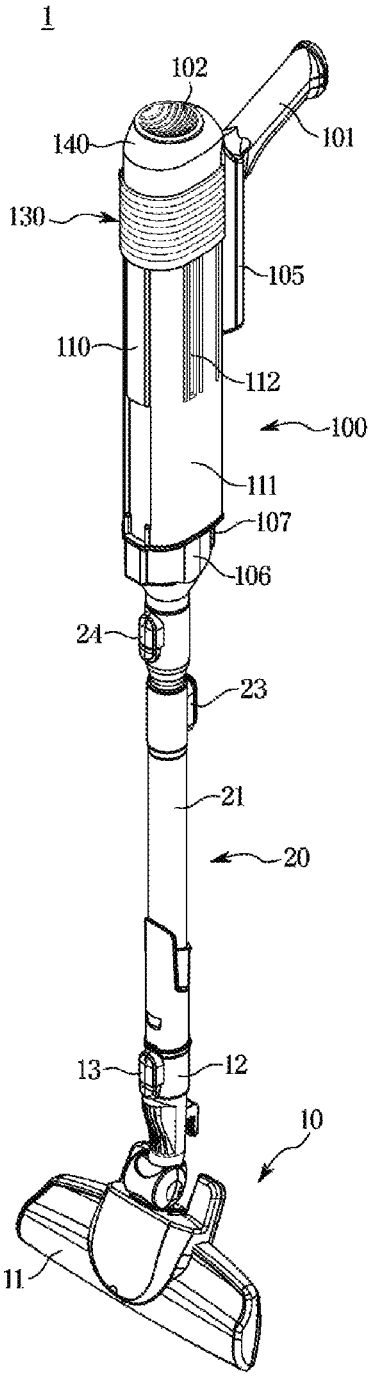
FIG. 1 is a perspective view of a cleaner according to an embodiment of the disclosure.

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

In addition, the same reference numerals or signs shown in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

Hereinafter an embodiment according to the disclosure will be described in detail with reference to the accompanying drawings. With respect to FIG. 1, a portion in which a suction head 10 is arranged may be defined as the front, a portion in which a dust collecting apparatus 100 is arranged may be defined as the rear, and a portion in which a gripping portion 101 is arranged may be defined as the lower side. That is, it is defined that air is introduced from the front of the cleaner 1 and discharged to the rear. However, the shape and position of each component is not limited by the terms defined in this way.

FIG. 1 is a perspective view of a cleaner according to an embodiment of the disclosure.

Figure 2:
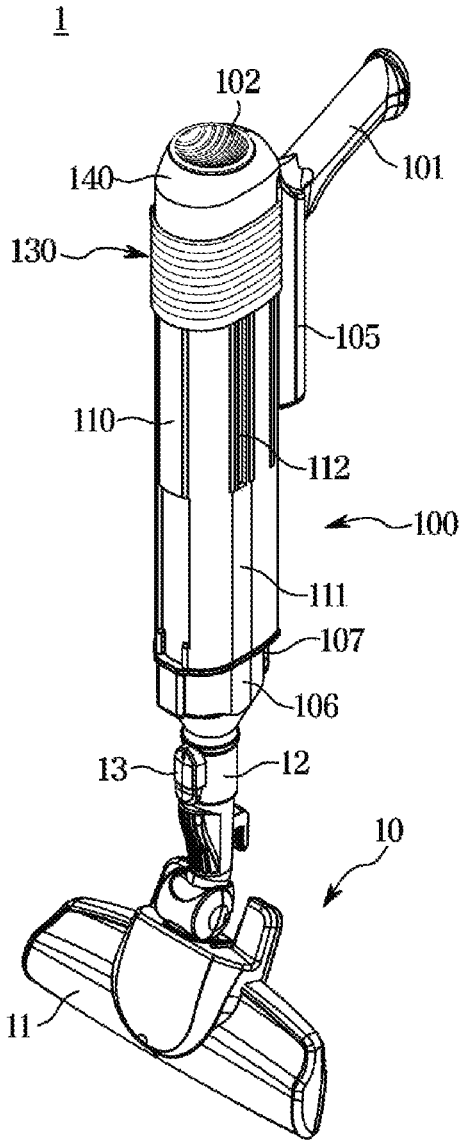
FIG. 2 is a view illustrating a state in which the cleaner of FIG. 1 is used without an extension tube according to an embodiment of the disclosure.

FIG. 2 is a view illustrating a state in which the cleaner of FIG. 1 is used without an extension tube according to an embodiment of the disclosure.

Figure 3:
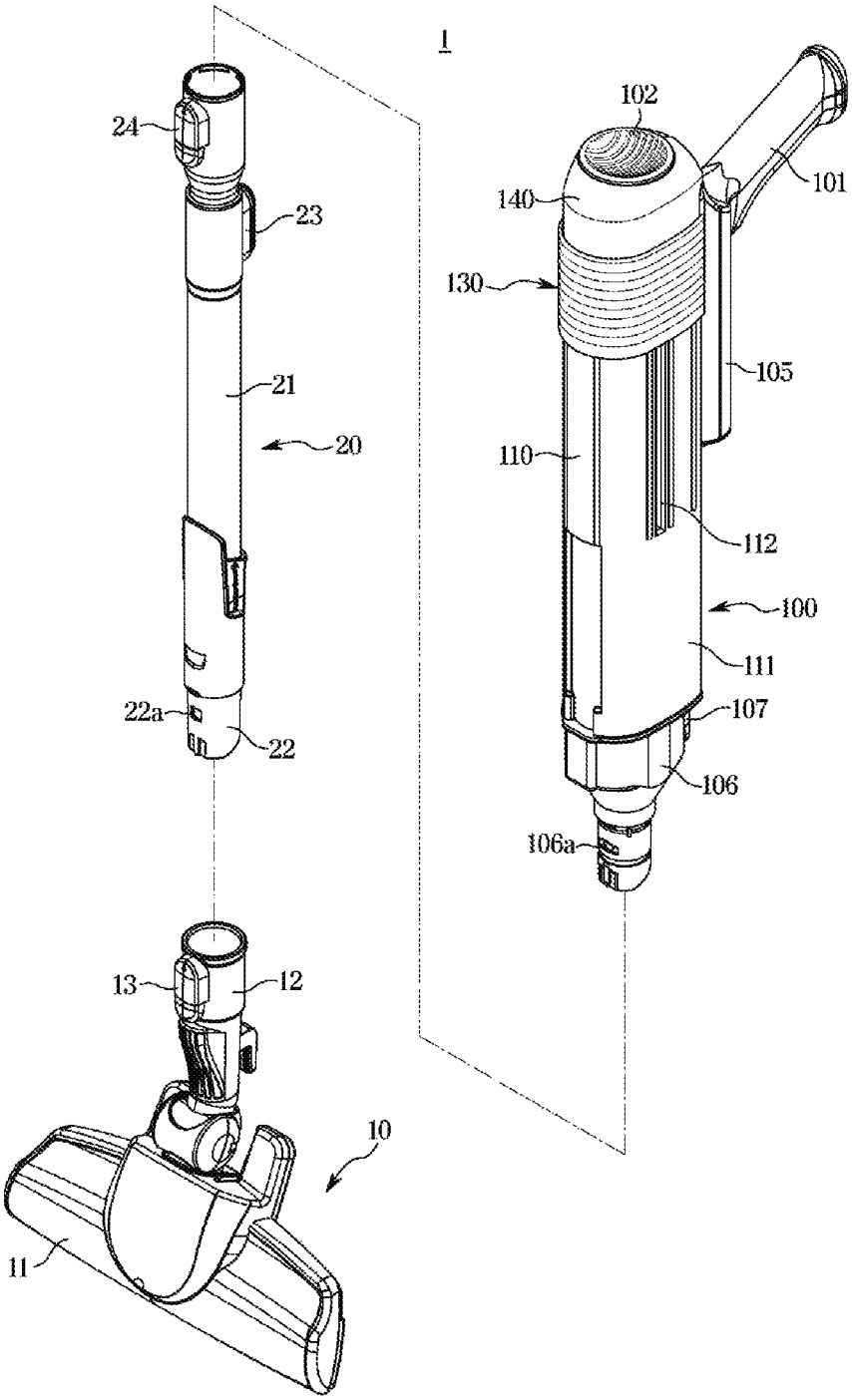
FIG. 3 is an exploded view of the cleaner of FIG. 1 according to an embodiment of the disclosure.

FIG. 3 is an exploded view of the cleaner of FIG. 1 according to an embodiment of the disclosure.

Referring to FIGS. 1 to 3, the cleaner 1 may include transfer devices 10 and 20 configured to suction rubbish such as human hair on a surface to be cleaned by using a suction force of air and guide the suctioned rubbish to the dust collecting apparatus 100, and the dust collecting apparatus 100 configured to supply the suction force to the transfer devices 10 and 20 and configured to collect the rubbish transferred through the transfer devices 10 and 20.

Referring to FIG. 1, the transfer devices 10 and 20 may include a suction head 10 configured to suction rubbish on the surface to be cleaned, and an extension tube 20 configured to guide the rubbish introduced through the suction head 10 to the dust collecting apparatus 100. When the transfer devices 10 and 20 include the suction head 10 and the extension tube 20, the cleaner 1 may easily clean a region far from the dust collecting apparatus 100.

The suction head 10 is configured to suction rubbish such as dust on the surface to be cleaned while traveling on the surface to be cleaned. The suction head 10 may be detachably connected to one end of the extension tube 20.

The suction head 10 may include a head 11 arranged to face the surface to be cleaned when the cleaner 1 is driven, and a neck 12 rotatably connected to the head 11. An air flow path may be formed inside the head 11. The air flow path formed inside the head 11 may communicate with the extension tube 20 through the neck 12. Therefore, external air and rubbish introduced through the suction head 10 may be introduced into the extension tube 20 through the neck 12.

The suction head 10 may include a head switch 13 for maintaining or releasing an engagement with the extension tube 20. The head switch 13 may press one end of the extension tube 20 coupled to the neck 12 of the suction head 10 so as to fix a position of the extension tube 20 with respect to the suction head 10. When a user intends to separate the extension tube 20 from the suction head 10, the user may press the head switch 13 to release the extension tube 20 and then separate the extension tube 20. The head switch 13 may include a locking portion (not shown), and when the locking portion is locked to an extension groove 22*a* of the extension tube 20, the suction head 10 may be fixed to the extension tube 20.

One end of the extension tube 20 may be connected to the suction head 10, and the other end thereof may be connected to the dust collecting apparatus 100. The extension tube 20 may form a part of the appearance of the cleaner 1.

The extension tube 20 may include an extension case 21. The extension case 21 may form an extension flow path (not shown) therein. The extension flow path may guide air, which passes through the suction head 10, to the dust collecting apparatus 100.

The extension tube 20 may include an extension insert 22 inserted into the neck 12 of the suction head 10. When the extension insert 22 is inserted into the neck 12, the extension tube 20 may be fixed to the suction head 10 based on the pressure applied to the extension insert 22 by the head switch 13. The extension insert 22 may include the extension groove 22*a* in which one portion of the head switch 13 is inserted and locked thereto.

The extension tube 20 may include a suction force regulator 23. The suction force regulator 23 may be configured to allow the extension tube 20 to selectively communicate with the outside of the extension tube. When the suction force regulator 23 is opened, the extension flow path of the extension tube 20 may be in communication with the outside of the extension tube 20, and thus the suction force may be reduced.

The extension tube 20 may include a dust collecting apparatus fixing unit 24 for fixing the dust collecting apparatus 100 inserted into the extension tube 20. When one end of the dust collecting apparatus 100 is inserted into the extension tube 20, the dust collecting apparatus fixing unit 24 may press one end of the dust collecting apparatus 100 to fix the dust collecting apparatus 100 to the extension tube 20. When a user intends to separate the extension tube 20 from the dust collecting apparatus 100, the user may push the dust collecting apparatus fixing unit 24 to release the dust collecting apparatus 100 and then separate the dust collecting apparatus 100. The dust collecting apparatus fixing unit 24 may include a locking portion (not shown), and when the locking portion of the dust collecting apparatus fixing unit 24 is locked to a connection groove 106*a* of the dust collecting apparatus 100, the dust collecting apparatus fixing unit 24 may be fixed to the dust collecting apparatus 100.

Referring to FIG. 2, unlike FIG. 1, the cleaner 1 may directly connect the suction head 10 to the dust collecting apparatus 100 without the extension tube 20. Accordingly, the air flow path inside the head 11 may communicate with the dust collecting apparatus 100 through the neck 12. Therefore, external air and rubbish introduced through the suction head 10 may flow into the dust collecting apparatus 100 through the neck 12. In addition, through the head switch 13, the engagement between the suction head 10 and the dust collecting apparatus 100 may be maintained or released. As a fixing portion of the head switch 13 is locked to the connection groove 106*a* of the dust collecting apparatus 100, the suction head 10 may be fixed to the dust collecting apparatus 100.

The dust collecting apparatus 100 may be connected to the transfer devices 10 and 20. Particularly, the dust collecting apparatus 100 may be connected to the extension tube 20 as illustrated in FIG. 1, or connected to the suction head 10 as illustrated in FIG. 2.

The dust collecting apparatus 100 may include a dust collector 110 and a driver 140. The dust collector 110 and the driver 140 may form a part of the appearance of the cleaner 1. The driver 140 may be detachably provided at the dust collector 110. The dust collector 110 may include a housing 111.

The dust collecting apparatus 100 may include a gripping portion 101. The gripping portion 101 may be arranged at the end of the driver 140 to facilitate the user gripping. When a user uses the cleaner 1, the user may push or pull the suction head 10 by gripping the gripping portion 101.

The dust collecting apparatus 100 may include a discharge port 102 formed at the other end opposite to one end connected to the transfer devices 10 and 20. The discharge port 102 may be arranged on the rear surface of the driver 140. The discharge port 102 may include a plurality of discharge holes. The position of the discharge port 102 is not limited to the rear surface of the driver 140 and may be formed on at least one surface of the upper surface and the left and right surface of the driver 140. The discharge port 102 may be formed to discharge the filtered air.

The dust collecting apparatus 100 may include a battery mounting portion 105. The battery mounting portion 105 may be provided below the driver 140. A battery (not shown) configured to supply power for driving the cleaner 1 may be mounted to the battery mounting portion 105. The battery may be a rechargeable battery.

The dust collecting apparatus 100 may include a connection port 106. The connection port 106 may be detachably mounted to the dust collector 110. The connection port 106 may be connectable to the neck 12 of the suction head 10 and/or the extension tube 20. When the cleaner 1 is used as shown in FIG. 1, the connection port 106 may be inserted into one end of the extension tube 20 and fixed by the dust collecting apparatus fixing unit 24. When the cleaner 1 is used as shown in FIG. 2, the connection port 106 may be inserted into the neck 12 of the suction head 10 and fixed by the head switch 13. That is, the connection port 106 may be configured to be removably coupled to the transfer devices 10 and 20. The connection port 106 may be provided to be compatible with various transfer devices 10 and 20. When the rubbish is discharged from the dust chamber 120, the connection port 106 may be separated from the housing 111 of the dust collector 110.

The connection port 106 may include a connection switch 107 for maintaining or releasing the engagement with the dust collector 110. The connection switch 107 may press a connection portion 111*a* of the housing 111 of the dust collector 110, thereby fixing the position of the extension port 106 with respect to the dust collector 110. When a user intends to separate the connection port 106 from the dust collector 110, the user may press the connection switch 107 to release the housing 111 and then separate the extension tube 20. The connection switch 107 may include a locking portion (not shown), and when the locking portion of the connection switch 107 is locked to a housing groove (not shown) formed in the connection portion 111*a* of the housing 111, the connection port 106 may be fixed to the dust collector 110.

The dust collecting apparatus 100 may include a rubbish remover 130. The rubbish remover 130 may be configured to discharge rubbish collected in the dust chamber 120 (refer to FIG. 4) to the outside of the dust chamber 120. The rubbish remover 130 may be slidable with respect to the housing 111. The rubbish remover 130 may be provided in the dust collector 110.

The housing 111 of the dust collector 110 may include a guide 112 configured to guide the sliding movement of the rubbish remover 130. The guide 112 may extend in the front and rear direction. The guide 112 may be arranged on opposite sides of the housing 111.

Figure 4:
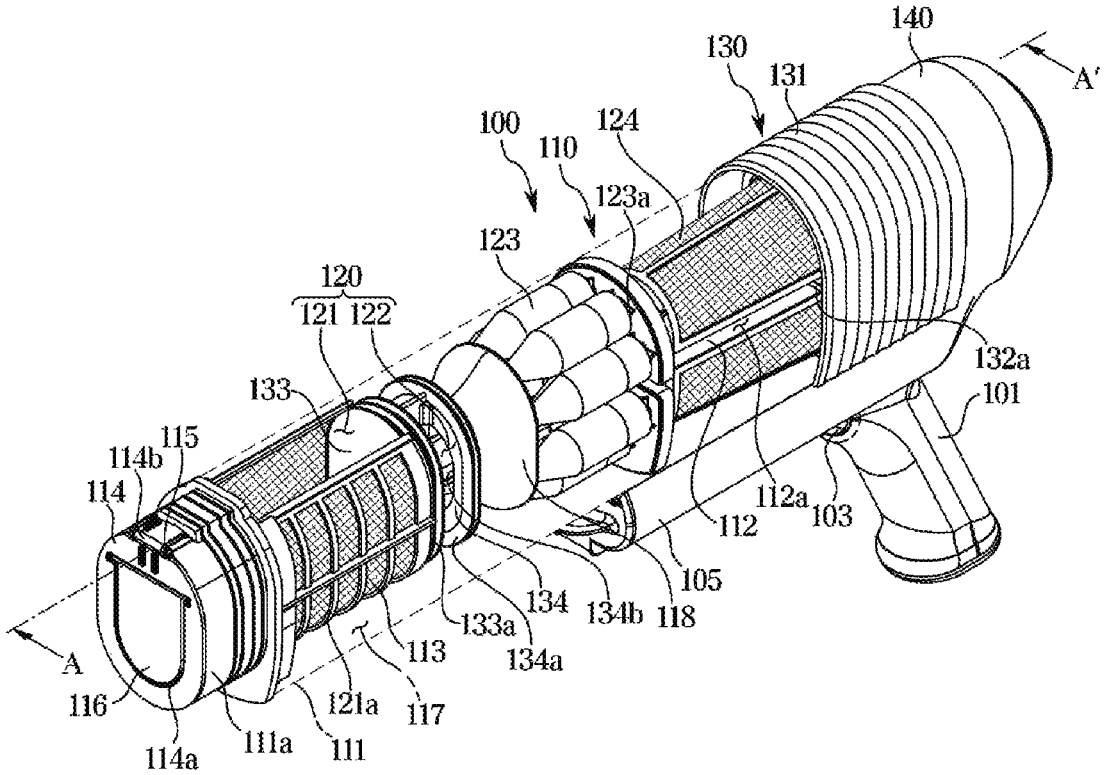
FIG. 4 is a view illustrating an interior of a dust collecting apparatus of FIG. 3 according to an embodiment of the disclosure.

FIG. 4 is a view illustrating an interior of a dust collecting apparatus of FIG. 3 according to an embodiment of the disclosure.

Figure 5:
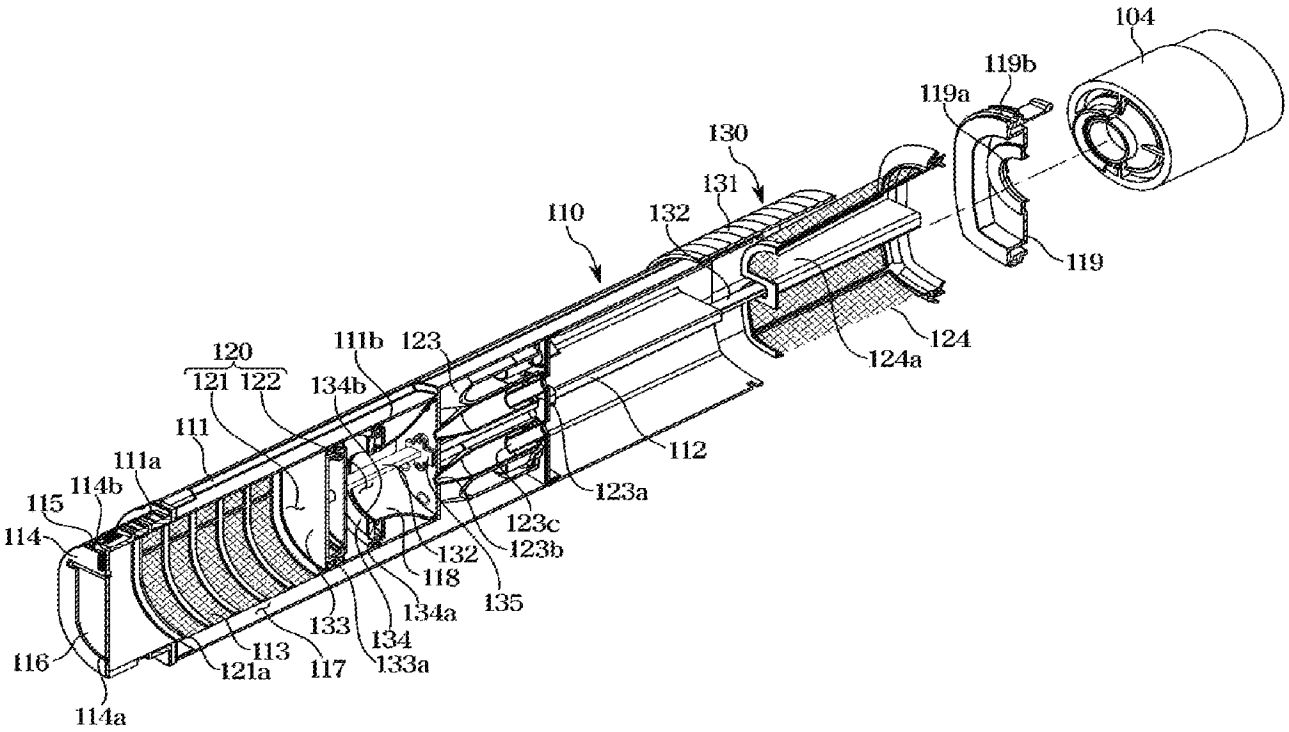
FIG. 5 is a cross-sectional view taken along line A-A' of FIG. 4 according to an embodiment of the disclosure.

FIG. 5 is a cross-sectional view taken along line A-A' of FIG. 4 according to an embodiment of the disclosure.

Figure 6:
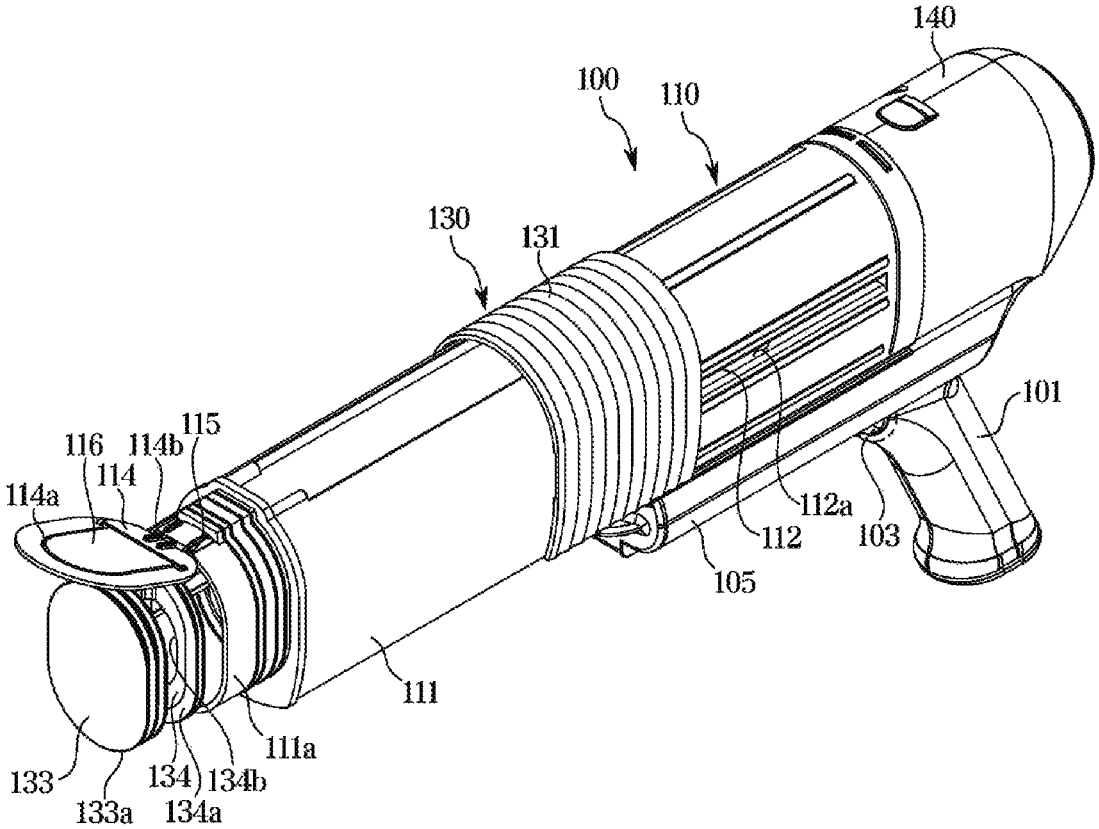
FIG. 6 is a view illustrating a state in which a dust chamber of the dust collecting apparatus of FIG. 4 is emptied according to an embodiment of the disclosure.

FIG. 6 is a view illustrating a state in which a dust chamber of the dust collecting apparatus of FIG. 4 is emptied according to an embodiment of the disclosure.

Referring to FIGS. 4 and 5, in the dust collecting apparatus 100, an operation switch 103 configured to control whether to operate the cleaner 1 may be provided. The operation switch 103 is configured to receive a user intension regarding the operation of the cleaner 1. The operation switch 103 may be arranged on the gripping portion 101 for a user to easily operate the operation switch 103.

The dust collecting apparatus 100 may include a fan motor unit 104 for generating a suction force required to suction the rubbish on the surface to be cleaned. The fan motor unit 104 may be configured to suction the outside air through the suction head 10 and discharge the suctioned air to the discharge port 102. The fan motor unit 104 may be arranged inside the other end opposite to one end connected to the transfer devices 10 and 20 of the dust collecting apparatus 100. The fan motor unit 104 may be arranged in the driver 140.

The dust collecting apparatus 100 may include an opening and closing member 114 provided at the connection portion 111*a* of the housing 111 connected to the connection port 106. One end of the housing 111 in which the connection portion 111*a* is arranged may be opened, and the opening and closing member 114 may be configured to open and close the one end of the housing 111. The opening and closing member 114 may be configured to open and close a first dust chamber 121. The opening and closing member 114 may include a chamber inlet 114*a* formed to allow air introduced from the transfer devices 10 and 20 to flow to the first dust chamber 121.

The opening and closing member 114 is rotatably coupled to a shaft 115 of the housing 111 to rotate with respect to the shaft 115 corresponding to a rotation axis. The opening and closing member 114 may include a shaft coupling portion 114*b* rotatably coupled to the shaft 115.

The chamber inlet 114*a* of the opening and closing member 114 may be opened and closed by a first cover 116. The first cover 116 may be formed to include a material having elasticity. The first cover 116 may open the chamber inlet 114*a* in a direction in which air flows into the first dust chamber 121. On the other hand, the first cover 116 may be configured to prevent the chamber inlet 114*a* from being opened in a direction opposite to a direction in which air is introduced from the first dust chamber 121. That is, when the cleaner 1 suctions the rubbish on the surface to be cleaned, the first cover 116 may open the chamber inlet 114*a*, and at the same time, the first cover 116 may prevent the chamber inlet 114*a* from being opened to a direction to which dust is discharged from the first dust chamber 121. Accordingly, the cleaner 1 may prevent the rubbish from scattering even when the dust collecting apparatus 100 is separated from the transfer devices 10 and 20.

The first cover 116 may include a fixing portion 116*a* (refer to FIG. 7) fixed to the opening and closing member 114. When the fan motor unit 104 generates a suction force, the first cover 116 may be elastically deformed in a state in which the fixing portion 116*a* is fixed, and thus the first cover 116 may open the chamber inlet 114*a*. When the fan motor unit 104 does not generate a suction force, the first cover 116 may return to a position of closing the chamber inlet 114*a* by the elastic force.

Alternatively, the first cover 116 may be rotatably coupled to the opening and closing member 114 and elastically biased in the direction of closing the chamber inlet 114*a*.

The first dust chamber 121 and a second dust chamber 122 may be formed in the housing 111. The first dust chamber 121 may collect the rubbish that is filtered out when the air introduced through the transfer devices 10 and 20 passes through a filtering device 113. The second dust chamber 122 may collect the rubbish separated from the air by a rubbish separator 123. The housing 111 may include a chamber housing 111*b* forming the first dust chamber 121 and the second dust chamber 122.

The dust collecting apparatus 100 may include the filtering device 113 arranged inside the first dust chamber 121. The filtering device 113 may firstly filter out the rubbish contained in the air introduced through the transfer devices 10 and 20. The filtering device 113 may be arranged apart from an inner surface of the housing 111 by a predetermined distance. The filtering device 113 may be arranged to correspond to the circumference of the chamber housing 111*b*. The filtering device 113 may be arranged in a filtering opening 121*a* formed at a portion along the circumference of the chamber housing 111*b*. The rubbish filtered out by the filtering device 113 may be collected in the first dust chamber 121. The filtering device 113 may be formed of a mesh member.

The air passing through the filtering device 113 may be guided to the rubbish separator 123 through a transfer channel 117 formed inside the housing 111. The transfer channel 117 may allow the first dust chamber 121 to communicate with the rubbish separator 123. The transfer channel 117 may be formed on the outside of the chamber housing 111*b*.

Air passing through the transfer channel 117 may be introduced into the dust separator 123 through a cyclone opening 123*a*. The rubbish contained in the introduced air is centrifuged from the air and collected in the second dust chamber 122 through a dust collecting opening 123*b*, and the air may move toward a filter member 124 through an air passing opening 123*c*.

The dust collecting apparatus 100 may include the rubbish separator 123 installed inside the housing 111 while being positioned behind the second dust chamber 122. The rubbish separator 123 may secondly filter the air passing through the filtering device 113. The rubbish separator 123 may include at least one cyclone. The first dust chamber 121 may filter out the rubbish in the air by using the filtering device 113, but the second dust chamber 122 may centrifuge the rubbish from the air by using the cyclone.

The dust collecting apparatus 100 may include a dust guide 118 configured to guide the rubbish filtered out by the rubbish separator 123 to the second dust chamber 122. One end of the dust guide 118 may communicate with the rubbish separator 123, and the other end thereof may communicate with the second dust chamber 122. The one end of the dust guide 118 may communication with the dust collecting opening 123*b* of at least one cycle of the rubbish separator 123. The dust guide 118 may receive the rubbish, which is filtered out by the rubbish separator 123, from one end thereof and may guide the rubbish to the second dust chamber 122 through the other end thereof.

The dust collecting apparatus 100 may include the filter member 124. The filter member 124 may be arranged inside the housing 111. The filter member 124 may thirdly filter the air passing through the rubbish separator 123. The filter member 124 may be formed of a mesh member. The air passing through the filter member 124 may pass through a communication port 119*a* formed in a second cover 119 of the housing 111 and the discharge port 102, sequentially and then discharged to the outside of the dust collecting apparatus 100.

The filter member 124 may include a guide counterpart 124*a* formed to correspond to the guide 112 of the housing 111. The guide 112 may be inserted into the guide counterpart 124*a* of the filter member 124.

The dust collector 110 may include the second cover 119 configured to cover the open rear surface of the housing 111. The second cover 119 may be removably mounted to the housing 111. The second cover 119 may include the communication port 119*a* for allowing the dust collector 110 to communicate with the driver 140. Air discharged from the dust collector 110 after passing through the filter member 124 may move to the driver 140 through the communication port 119*a*. A cover sealing member 119*b* for sealing with the housing 111 may be provided at an edge of the second cover 119 facing the housing 111.

When the filter member 124 needs to be replaced, a user may separate the driver 140 from the dust collector 110 and then separate the second cover 119 from the housing 111, thereby replacing the filter member 124 arranged inside the housing 111.

The rubbish remover 130 may be configured to discharge the dust collected in the dust chamber 120 to the outside of the housing 111. The rubbish remover 130 may be provided in the dust collector 110. The rubbish remover 130 may include a handle 131, a link 132, a first rubbish removal member 133, and a second rubbish removal member 134.

The handle 131 may be slidable along the outer surface of the housing 111. The handle 131 may be formed in a shape corresponding to a portion of the outer surface of the housing 111. The handle 131 may be arranged to be exposed to the outside of the housing 111. A user may operate the rubbish remover 130 by sliding the handle 131. The handle 131 may be arranged to cover at least a portion of the guide 112.

The link 132 may extend along the front and rear direction. At least a portion of the link 132 may be arranged in the inside of the housing 111. One end of the link 132 may be fixed to the handle 131. The link 132 may be integrally formed with the handle 131. The first rubbish removal member 133 and the second rubbish removal member 134 may be fixed to the other end of the link 132. The link 132 may move together with the handle 131 along the front and rear direction with respect to the housing 111 when the handle 131 slides. As the link 132 moves in the front and rear direction, the first rubbish removal member 133 and the second rubbish removal member 134 may slide in the inside of the housing 111.

The link 132 may include a link fixing portion 132*a* fixed to the handle 131. The link fixing portion 132*a* may extend along the left and right direction. That is, the link 132 may include a portion extending in the front and rear direction and the link fixing portion 132*a* extending in the left and right direction. The link 132 may be provided in an approximately 'L' shape.

The movement of the link 132 may be guided by the guide 112 of the housing 111. A portion of the link 132 extending in the front and rear direction and a portion of the link fixing portion 132*a* may be slidably inserted into the guide 112. At least a portion of the link 132 may be slidably inserted into the guide 112. One portion of the link 132 may be arranged on the outside of the housing 111, and the other portion thereof may be arranged in the inside of the housing 111. A portion of the link 132 in the side connected to the handle 131 may be arranged on the outside of the housing 111, and a portion of the link 132 in the side in which the first rubbish removal member 133 and the second rubbish removal member 134 are provided may be arranged in the inside of the housing 111.

The rubbish remover 130 may include a link sealing member 135 arranged at a portion where the link 132 is inserted into the chamber housing 111*b*. In order to prevent the loss of the suction force generated in the inside of the housing 111 by the fan motor unit 104, the link sealing member 135 may be arranged at a portion where the inside and the outside of the housing 111 communicate with each other.

Particularly, the guide 112 may form a sliding space 112*a* recessed inward from the outer surface of the housing 111 to allow the link 132 to slide. Accordingly, at least a portion of the link 132 may be arranged in the sliding space 112*a* of the guide 112 formed on the outside of the housing 111. In order to transmit the moving force of the handle 131 to the first rubbish removal member 133 and the second rubbish removal member 134, the link 132 may extend from the handle 131 to the first rubbish removal member 133 and the second rubbish removal member 134, which are arranged in the inside of the chamber housing 111*b*, through the sliding space 112*a*. Accordingly, a communication portion in which the link 132 is inserted into the chamber housing 111*b* is generated in the housing 111, and the communication portion is formed to allow the inside to communicate with the outside of the housing 111. In this case, because suction force generated inside the dust collecting apparatus 100 may be lost, the dust collecting apparatus 100 may include the link sealing member 135 arranged on a portion in which the link 132 passes through the chamber housing 111*b* to seal a portion in which the inside of the housing 111 communicates with the outside of the housing 111. By using the link sealing member 135, the dust collecting apparatus 100 may prevent the suction force from being lost.

The first rubbish removal member 133 may be arranged at one end of the link 132. The first rubbish removal member 133 may be formed to include a material having elasticity. The first rubbish removal member 133 may include a first contact portion 133*a* protruding toward the inner wall of the chamber housing 111*b*. The first contact portion 133*a* may be formed to include a material having elasticity. The first contact portion 133*a* may be formed to include a flexible material. The first contact portion 133*a* may be in close contact with the inner wall of the filtering device 113.

The first rubbish removal member 133 may be provided to be in close contact with one surface of the filtering device 113 on which the filtered out rubbish is placed. As the handle 131 slides with respect to the housing 111 and the link 132 moves along the front and rear direction, the first rubbish removal member 133 slides in a state of being in close contact with the inner surface of the filtering device 113. Based on the sliding movement of the handle 131 along the housing 111, the first rubbish removal member 133 may remove rubbish such as hair tangled to the inner surface of the filtering device 113 by scratching the inner surface of the filtering device 113.

The first rubbish removal member 133 may move from a first position between the filtering device 113 and the second dust chamber 122 as illustrated in FIGS. 4 and 5, to a second position protruding to the outside of the housing 111 as illustrated in FIG. 6. The first position may correspond to a position between the first dust chamber 121 and the second dust chamber 122. Accordingly, the first rubbish removal member 133 may discharge the rubbish placed in the first dust chamber 121 to the outside. In addition, as the first rubbish removal member 133 protrudes to the outside of the housing 111, dust collected in the second dust chamber 122 may also be discharged to the outside.

The second rubbish removal member 134 may be fixed to a portion of the link 132. The second rubbish removal member 134 may be spaced apart from the first rubbish removal member 133 in the rear side by a predetermined distance. The second rubbish removal member 134 may be provided to form the second dust chamber 122 together with the first rubbish removal member 133 and the chamber housing 111*b*.

The second rubbish removal member 134 may be formed to include a material having elasticity. The second rubbish removal member 134 may be provided to slide in close contact with the chamber housing 111*b* when the handle 131 slides with respect to the housing 111. The second rubbish removal member 134 may be provided to slide in the inner surface of the chamber housing 111*b*. When the handle 131 slides with respect to the housing 111, the second rubbish removal member 134 may slide in the inner surface of the chamber housing 111*b* and the inner surface of the filtering device 113 and then transfer rubbish placed in the second dust chamber 122 to the outside of the housing 111.

The second rubbish removal member 134 may include a second contact portion 134*a* protruding toward the inner wall of the chamber housing 111*b*. The second contact portion 134*a* may be formed to include a material having elasticity. The second contact portion 134*a* may include a flexible material. The second contact portion 134*a* may be in close contact with the inner wall of the chamber housing 111*b*.

The second rubbish removal member 134 may include a chamber opening 134*b* formed to allow the second dust chamber 122 to communicate with the dust guide 118. The rubbish separated from the rubbish separator 123 may be moved to the dust guide 118, and the dust guide 118 may guide the rubbish to the second dust chamber 122 through the chamber opening 134*b*.

According to the above-described configuration, when the cleaner 1 according to an embodiment of the disclosure performs the cleaning operation, the air containing the rubbish introduced from the suction head 10 may be firstly filtered by the filtering device 113 of the first dust chamber 121. Thereafter, the air moved to the rubbish separator 123 through the transfer channel 117 may be secondly filtered by the rubbish separator 123 and then collected in the second dust chamber 122. The air passing through the rubbish separator 123 may pass through the air passing opening 123*c* and thirdly filtered by the filter member 124 and then the filtered air may be discharged to the outside through the discharge port 102.

Figure 7:
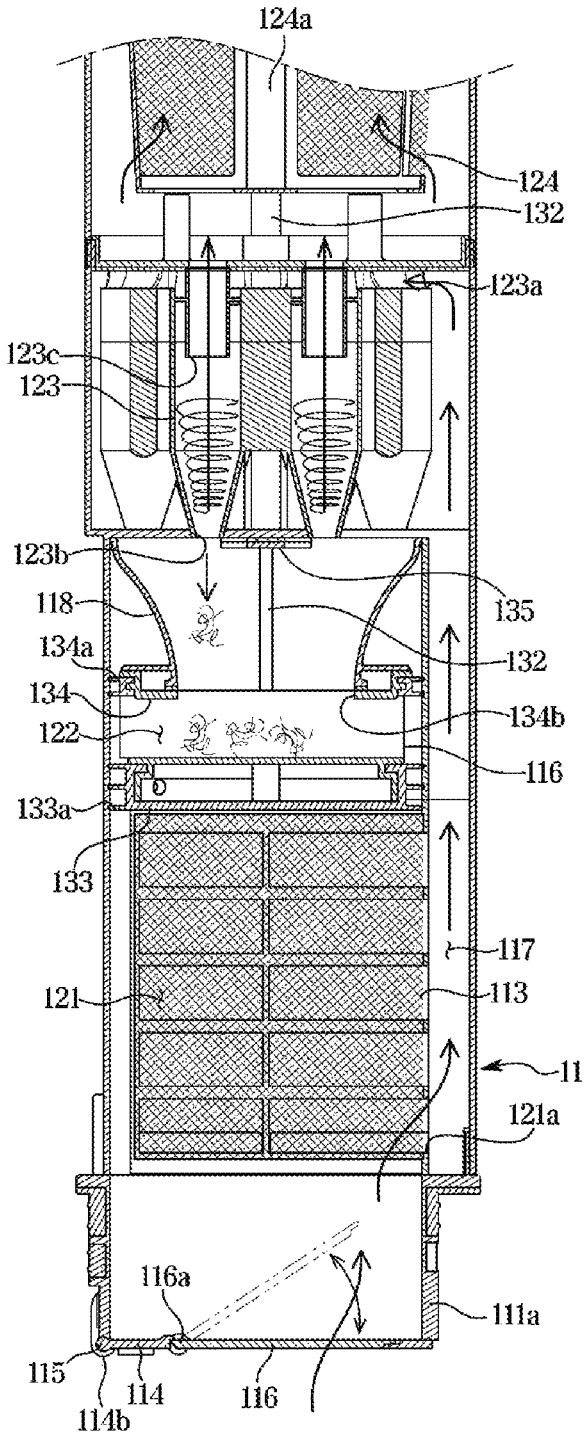
FIG. 7 is a view illustrating a state in which the dust collecting apparatus of the cleaner of FIG. 4 collects dust according to an embodiment of the disclosure.

FIG. 7 is a view illustrating a state in which the dust collecting apparatus of the cleaner of FIG. 4 collects dust according to an embodiment of the disclosure.

Figure 8:
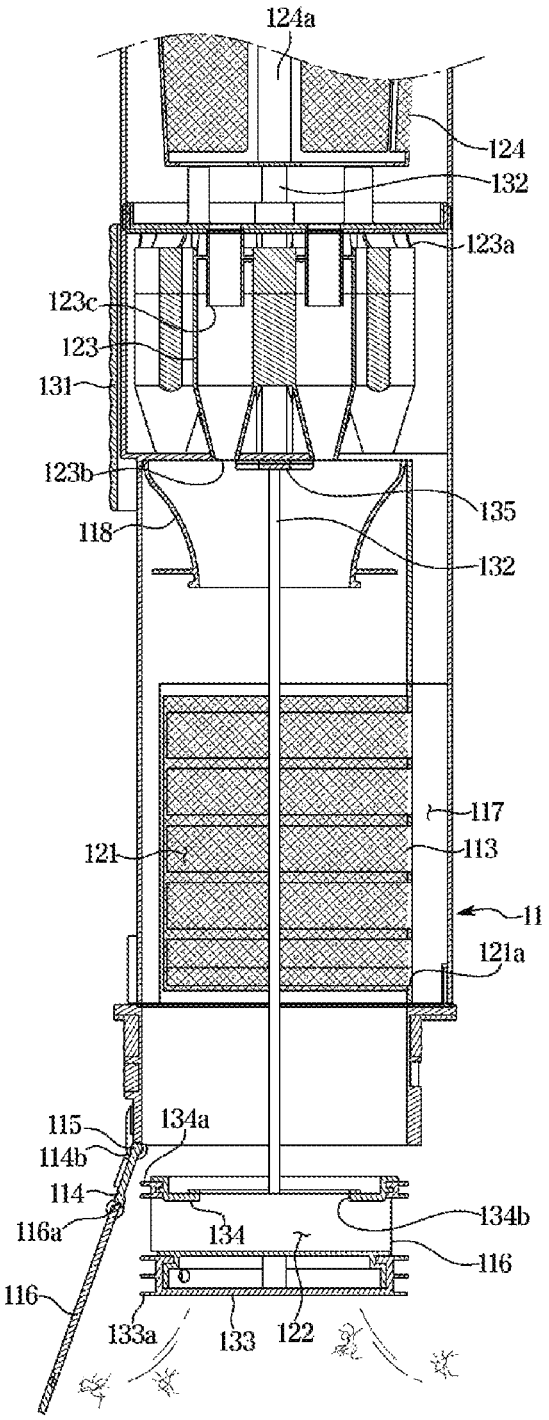
FIG. 8 is a cross-sectional view of the dust collecting apparatus of FIG. 6 according to an embodiment of the disclosure.

FIG. 8 is a cross-sectional view of the dust collecting apparatus of FIG. 6 according to an embodiment of the disclosure.

The driving of the cleaner 1 will be described in detail with reference to FIGS. 7 and 8.

Referring to FIG. 7, when the cleaner 1 performs the cleaning operation, the fan motor unit 104 may generate a suction force inside the cleaner 1. As the suction force is generated, air containing rubbish on the surface to be cleaned is moved to the dust collecting apparatus 100 through the transfer devices 10 and 20.

When the suction force is generated in the inside of the cleaner 1, the first cover 116 may open the chamber inlet 114*a*. Air containing the rubbish is introduced into the first dust chamber 121 through the chamber inlet 114*a*. The air containing the rubbish in the first dust chamber 121 may be firstly filtered by the filtering device 113. The rubbish filtered out by the filtering device 113 is collected in the first dust chamber 121. The air, which contains the rubbish and passes through the filtering device 113, is moved to the transfer channel 117.

The air passing through the transfer channel 117 flows into the rubbish separator 123 through the cyclone opening 123*a*. The air containing the rubbish may be secondly filtered by a cyclone method in the rubbish separator 123. The rubbish separated by the rubbish separator 123 is collected in the second dust chamber 122 through the dust guide 118. The air passing through the rubbish separator 123 may be moved toward the filter member 124 through the air passing opening 123*c*.

The air, which contains the rubbish and passes through the rubbish separator 123, passes through the filter member 124. The air thirdly filtered by the filter member 124 passes through the communication port 119*a* of the second cover 119, and then is discharged to the outside of the dust collecting apparatus 100 through the discharge port 102.

Because the cleaner 1 according to an embodiment of the disclosure filters the air containing the rubbish three times using the mentioned above configuration, it is possible to increase the cleaning efficiency.

Referring to FIG. 8, when the cleaner 1 finishes the cleaning operation and it is required to discharge the rubbish collected in the dust chamber 120, the dust collecting apparatus 100 may be separated from the transfer devices 10 and 20. In addition, the connection port 106 may be separated from the housing 111 of the dust collector 110. A user may move the handle 131 forward. As the handle 131 slides forward along the housing 111, the link 132 moves forward.

As the link 132 is guided by the guide 112 and moves forward, the first rubbish removal member 133 and the second rubbish removal member 134 arranged at the end of the link 132 may slide forward in a state of being in close contact with the inner surface of the chamber housing 111*b* and/or the filtering device 113.

The first rubbish removal member 133 slides in the inner surface of the filtering device 113 and separates the rubbish placed in the filtering device 113 from the filtering device 113, thereby discharging the rubbish to the outside of the first dust chamber 121. To this end, the first rubbish removal member 133 may move to a position protruding to the outside of the housing 111.

In this case, the opening and closing member 114 may open the first dust chamber 121 by being pressed by the first rubbish removal member 133. The opening and closing member 114 may be elastically biased in a direction of closing the first dust chamber 121 by an elastic member (not shown).

While sliding in close contact with the chamber housing 111*b* and the filtering device 113, the second rubbish removal member 134 may push the rubbish collected in the second dust chamber 122 to the outside of the housing 111. Because the second rubbish removal member 134 slides in close contact with the inner surface of the filtering device 113, the second rubbish removal member 134 may secondly process the rubbish tangled on the inner surface of the filtering device 113.

According to this configuration, the cleaner 1 according to an embodiment of the disclosure may easily discharge the rubbish of the dust collecting apparatus 100 by a simple operation. In addition, by using the opening and closing member 114, it is possible to prevent the rubbish from scattering even when the dust collecting apparatus 100 is separated from the transfer devices 10 and 20.

In addition, because the cleaner 1 according to an embodiment of the disclosure may minimize the exposure of the remaining rubbish to the user when the dust chamber 120 is emptied, cleanliness in use may be improved. That is, as for the cleaner 1 according to an embodiment of the disclosure, the handle 131 is a component that is exposed to the user among the components of the rubbish remover 130, and the handle 131 is connected to the first and second rubbish removal members 133 and 134 through the link 132 that is inserted into the guide 112 so as not to be exposed to a user. Therefore, although the link 132 and first and second rubbish removal members 133 and 134 are contaminated upon discharging the rubbish, it is not exposed to the user and thus the cleanliness in use may be improved.

In addition, when the filter member 124 needs to be replaced, the user separates the driver 140 of the dust collecting apparatus 100 from the dust collector 110 and opens the second cover 119 to open the interior of the housing 111. Therefore, the use may easily replace the filter member 124 arranged in the inside of the housing 111.

Figure 9:
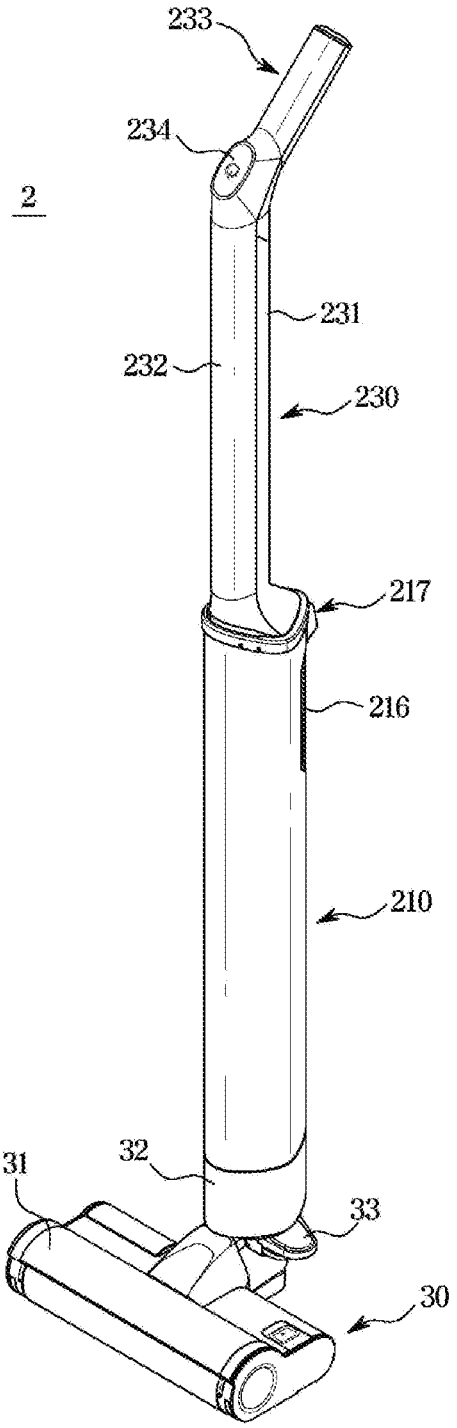
FIG. 9 is a perspective view of a cleaner according to another embodiment of the disclosure according to an embodiment of the disclosure.

FIG. 9 is a perspective view of a cleaner according to an embodiment of the disclosure.

Figure 10:
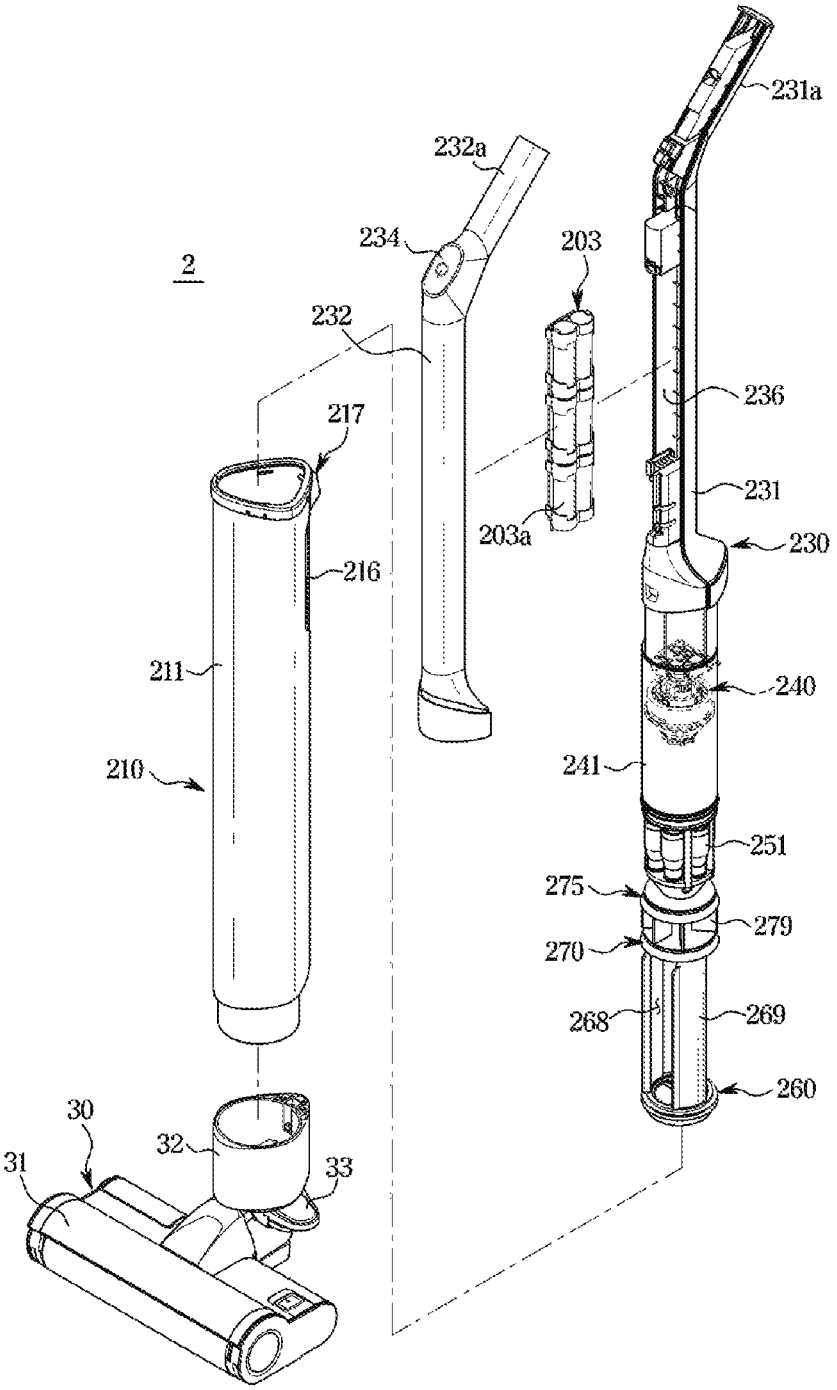
FIG. 10 is an exploded view illustrating the cleaner of FIG. 9 according to an embodiment of the disclosure.

FIG. 10 is an exploded view illustrating the cleaner of FIG. 9 according to an embodiment of the disclosure.

Figure 11:
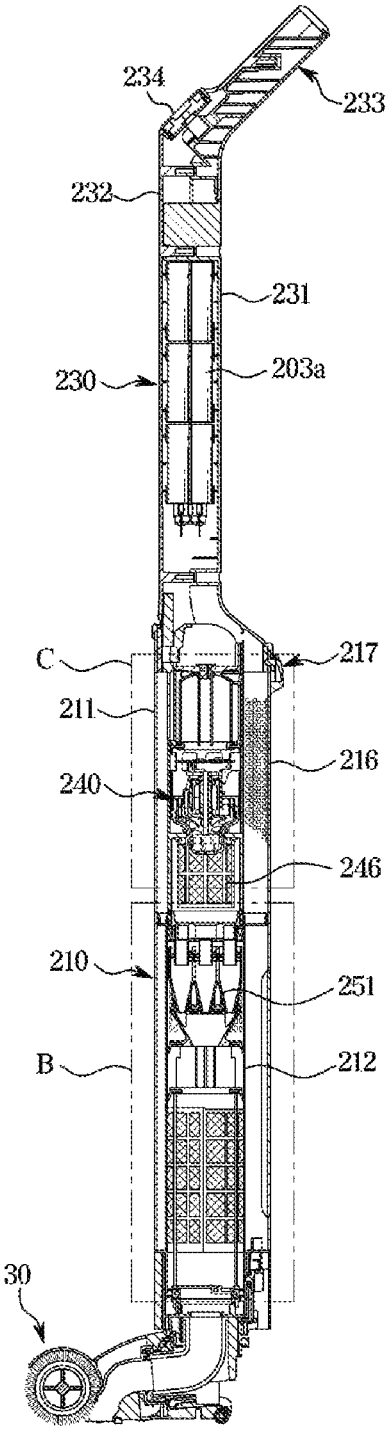
FIG. 11 is a cross-sectional view of the cleaner of FIG. 9 according to an embodiment of the disclosure.

FIG. 11 is a cross-sectional view of the cleaner of FIG. 9 according to an embodiment of the disclosure.

Referring to FIGS. 9 to 11, the cleaner 2 may include a suction head 30 configured to suction rubbish such as hair on a surface to be cleaned by a suction force of air, a dust collecting apparatus 210 configured to collect the rubbish suctioned through the suction head 30, and an extension member 230 slidably coupled to the dust collecting apparatus 210.

The suction head 30 may suction rubbish such as dust on the surface to be cleaned while traveling on the surface to be cleaned. The suction head 30 may include a head assembly 31, a neck 32, and a head switch 33.

An air flow path may be formed in the head assembly 31. The air flow path formed inside the head assembly 31 may communicate with the dust collecting apparatus 210 through the neck 32. External air and rubbish introduced through the head assembly 31 may move to the dust collecting apparatus 210 through the neck 32.

The neck 32 may be connected to a lower end of the dust collecting apparatus 210. The neck 32 may be rotatably coupled to the head assembly 31. As the neck 32 rotates with respect to the head assembly 31, the head assembly 31 may rotate with respect to the dust collecting apparatus 210 connected to the neck 32. Accordingly, the degree of freedom of driving of the cleaner 2 may be improved.

The head switch 33 is configured to maintain or release the engagement between the suction head 30 and the dust collecting apparatus 210. The head switch 33 may press a portion of the dust collecting apparatus 210 coupled to the neck 32 to fix the position of the dust collecting apparatus 210 with respect to the suction head 30. When a user intends to separate the dust collecting apparatus 210 from the suction head 30, the user operates the head switch 33 to release the dust collecting apparatus 210 and then separates the dust collecting apparatus 210 from the suction head 30. Because the head switch 33 is arranged on the suction head 30, the user can separate the dust collecting apparatus 210 from the suction head 30 by pressing the head switch 33 with the foot without bending over.

One end of the dust collecting apparatus 210 may be mounted to the suction head 30. The dust collecting apparatus 210 may include an outer case 211 and an inner case 212 arranged inside the outer case 211.

The dust collecting apparatus 210 may include a discharge port 216. The discharge port 216 may include a plurality of discharge holes. The discharge port 216 may discharge the filtered air. The discharge port 216 may be arranged on the rear surface of the dust collecting apparatus 210. The discharge port 216 may be formed at a portion of the rear surface of the outer case 211 corresponding to the position of a fan motor unit 240 when an opening and closing device 260 closes the first dust chamber 210*a*. Accordingly, the cleaner 2 according to another embodiment of the disclosure may prevent the filtered air from being discharged toward the user. However, the position of the discharge port 216 is not limited thereto, and may be located at any position as long as it can prevent the filtered air from being exposed to the user.

The dust collecting apparatus 210 may further include a button device 217 configured to fix the position of an extension member 230 with respect to the dust collecting apparatus 210. The button device 217 may fix or release the position of the extension member 230.

The extension member 230 may be slidably coupled to the dust collecting apparatus 210. The extension member 230 may be slidably coupled to the inner case 212 of the dust collecting apparatus 210. The extension member 230 may form a part of the appearance of the cleaner 2. The extension member 230 may include an extension case 231.

The extension case 231 may include a battery mounting portion 236. A battery unit 203 may be mounted to the battery mounting portion 236. The battery unit 203 may include at least one battery 203*a*. The battery mounting portion 236 may be covered by an extension cover 232.

The extension member 230 may include a handle 233 gripped by a user. The handle 233 may be arranged at an upper portion of the cleaner 2 to facilitate the user gripping. The handle 233 may be positioned at the other end opposite to one end in which the opening and closing device 260 is arranged. When a user uses the cleaner 2, the user may push or pull the suction head 30 by gripping the handle 233. The handle 233 may be formed in such a way that a case handle portion 231*a* formed in the extension case 231 is coupled to a cover handle portion 232*a* formed in the extension cover 232.

The extension member 230 may include an operation switch 234 for controlling whether to operate the cleaner 2. The operation switch 234 is configured to receive a user intension regarding the operation of the cleaner 2. The operation switch 234 may be adjacent to the handle 233 so that a user operates the operation switch 234 while moving the cleaner 2 in the cleaning operation.

The extension member 230 may include the fan motor unit 240 configured to generate a suction force required to suction the rubbish on the surface to be cleaned. The fan motor unit 240 may be configured to suction the outside air through the suction head 30 and discharge the suctioned air to the discharge port 216. The fan motor unit 240 may be arranged inside the outer case 211 while being mounted to the extension member 230.

Figure 12:
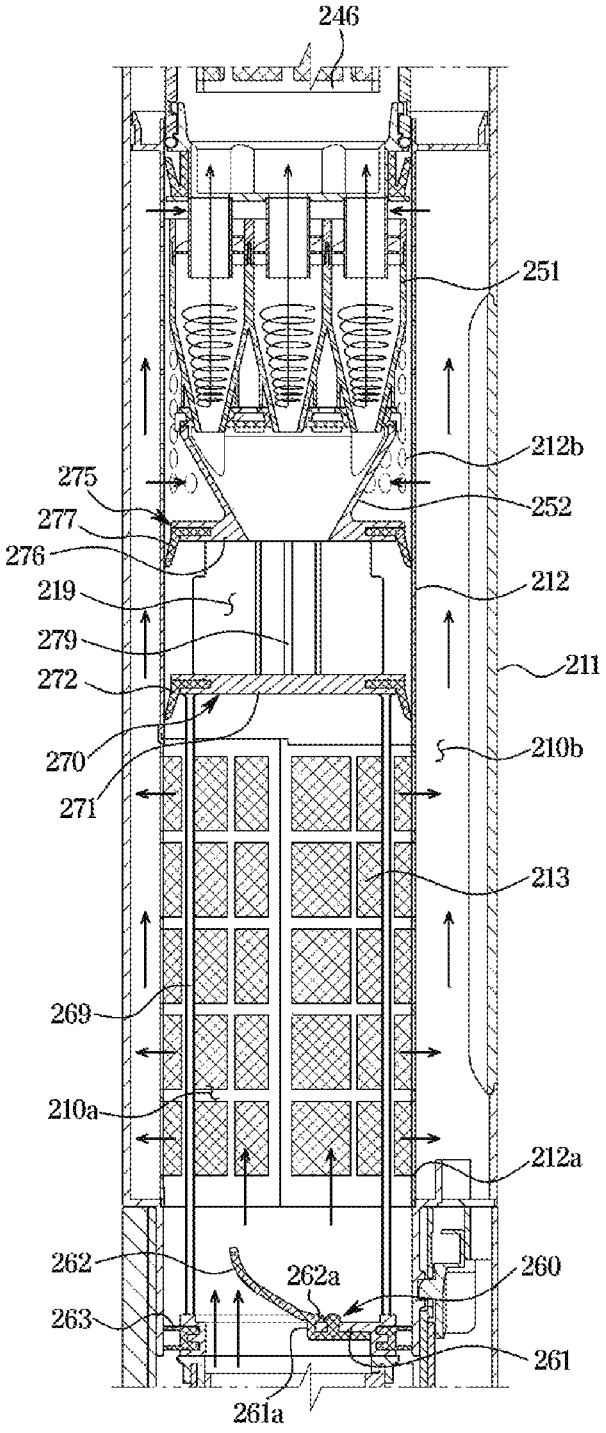
FIG. 12 is an enlarged view of a portion B of FIG. 11 according to an embodiment of the disclosure.

FIG. 12 is an enlarged view of a portion B of FIG. 11 according to an embodiment of the disclosure.

Figure 13:
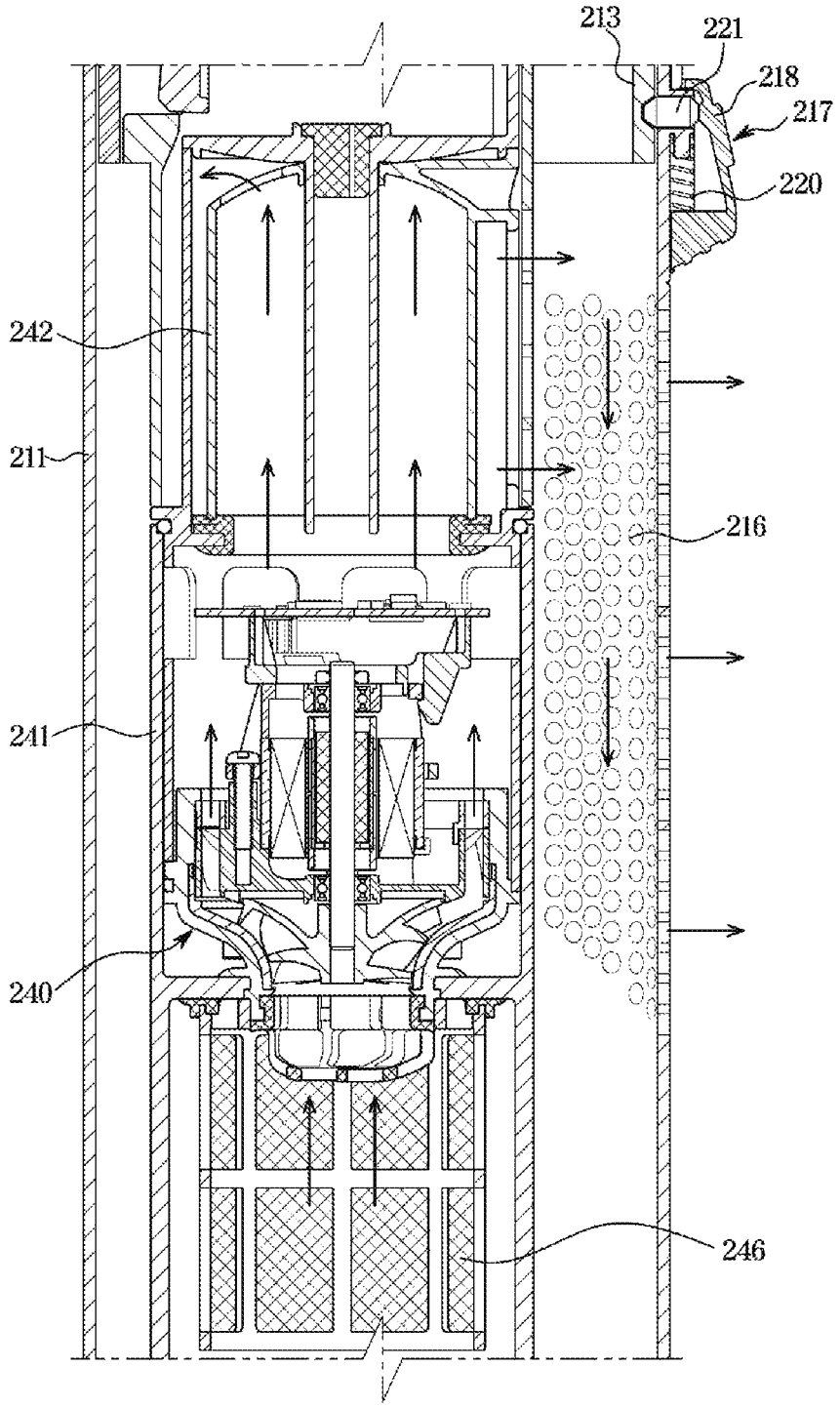
FIG. 13 is an enlarged view of a portion C of FIG. 11 according to an embodiment of the disclosure.

FIG. 13 is an enlarged view of a portion C of FIG. 11 according to an embodiment of the disclosure.

Referring to FIGS. 12 and 13, the dust collecting apparatus 210 and the extension member 230 will be described in details.

The dust collecting apparatus 210 may include the first dust chamber 210*a* and a second dust chamber 219 positioned downstream of the first dust chamber 210*a* along a direction in which air introduced from the suction head 30 is discharged through the discharge port 216.

The outer case 211 of the dust collecting apparatus 210 may form a portion of the appearance of the cleaner 2. Together with the inner case 212, the outer case 211 may form a case flow path 210*b*. The case flow path 210*b* may guide the air, which passes through the first dust chamber 210*a*, to the second dust chamber 219.

The inner case 212 may be arranged inside the outer case 211. The first dust chamber 210*a* may be formed inside the inner case 212. A filtering device 213 may be arranged inside the inner case 212. The first dust chamber 210*a* may collect the rubbish that is filtered out when the air introduced through the suction head 30 passes through the filtering device 213.

The filtering device 213 may firstly filter out the rubbish contained in the air introduced through the suction head 30. The filtering device 213 may extend along a portion of the inner surface of the inner case 212. The rubbish filtered out by the filtering device 213 may be collected in the first dust chamber 210*a*. The filtering device 213 may be formed of a mesh member.

The inner case 212 may include a first case opening 212*a* through which air passing through the filtering device 213 moves to the case flow path 210*b*. The filtering device 213 may be arranged to cover a portion of the inner case 212 in which the first case opening 212*a* is formed.

The inner case 212 may include a second case opening 212*b* through which air guided by the case flow path 210*b* flows into a rubbish separator 251.

The air introduced into the rubbish separator 251 through the second case opening 212*b* may be secondly filtered by the rubbish separator 251. The rubbish filtered out by the rubbish separator 251 may be collected in the second dust chamber 219. The air filtered by the rubbish separator 251 may move toward the fan motor unit 240.

The extension member 230 may include the opening and closing device 260 configured to open and close the first dust chamber 210*a*. The opening and closing device 260 may be arranged at an end of the extension member 230 facing the suction head 30. The opening and closing device 260 may interlock with a first rubbish removal member 270 and/or a second rubbish removal member 275. Because the opening and closing device 260 interlocks with the first rubbish removal member 270 and/or the second rubbish removal member 275, it is possible to prevent the first dust chamber 210*a* from being inadvertently opened, and thus it is possible to open the dust chambers 210*a* and 219 only when discharging the rubbish is required. The opening and closing device 260 may include an opening and closing member 261, an opening and closing cover 262, and an opening and closing sealing member 263.

The opening and closing device 260 moves in a direction away from the dust collecting apparatus 210 to open the first dust chamber 210*a* when the first rubbish removal member 270 is slidably moved out of the first dust chamber 210*a*. The opening and closing device 260 moves in a direction close to the dust collecting apparatus 210 to close the first dust chamber 210*a* when the first rubbish removal member 270 is slidably moved into the first dust chamber 210*a*.

The opening and closing member 261 may open and close the first dust chamber 210*a* based on the sliding movement of the extension member 230 with respect to the dust collecting apparatus 210. The opening and closing member 261 may include a chamber inlet 261*a* formed to allow air introduced from the suction head 10 to flow into the first dust chamber 210*a*. The chamber inlet 261*a* may be opened and closed by the opening and closing cover 262.

The opening and closing cover 262 may be formed to include a material having elasticity. The opening and closing cover 262 may open the chamber inlet 261*a* in a direction in which air flows into the first dust chamber 210*a*. Further, the opening and closing cover 262 may prevent the chamber inlet 261*a* from being opened in a direction opposite to a direction in which air is introduced from the first dust chamber 210*a*. That is, when the cleaner 2 suctions the rubbish on the surface to be cleaned, the opening and closing cover 262 may open the chamber inlet 261*a*, but at the same time, the opening and closing cover 262 may prevent the chamber inlet 261*a* from being opened to a direction to which dust is discharged from the first dust chamber 210*a*. Accordingly, the cleaner 2 may prevent the rubbish from scattering when the dust collecting apparatus 210 is separated from the suction head 30.

The opening and closing cover 262 may include a cover fixing portion 262*a*. When the fan motor unit 240 generates a suction force, the opening and closing cover 262 may be elastically deformed while the cover fixing portion 262*a* is fixed and then the opening and closing cover 262 may open the chamber inlet 261*a*. When the fan motor unit 240 does not generate the suction force, the opening and closing cover 262 may return to the position of closing the chamber inlet 261*a* by the elastic force.

The opening and closing sealing member 263 may be provided to seal between the dust collecting apparatus 210 and the opening and closing member 261. The opening and closing sealing member 263 may be arranged along the edge of the opening and closing member 261. The opening and closing sealing member 263 may be formed to include a material having elasticity. The opening and closing sealing member 263 may be formed to include a material more flexible than the opening and closing member 261. The opening and closing sealing member 263 may be in close contact with the inner surface of the inner case 212 and may seal the first dust chamber 210*a*. Accordingly, the cleaner 2 according to another embodiment of the disclosure may prevent the rubbish from leaking from the first dust chamber 210*a*.

The extension member 230 may include the first rubbish removal member 270 configured to discharge the rubbish of the first dust chamber 210*a*. The first rubbish removal member 270 may slide in the first dust chamber 210*a*. The first rubbish removal member 270 may include a first mounting portion 271 and a first rubbish removal portion 272 mounted on the first mounting portion 271.

The first rubbish removal portion 272 may be formed to include a material having elasticity. The first rubbish removal portion 272 may be formed to be in close contact with the inner wall of the filtering device 213. The first rubbish removal portion 272 may be provided to be in close contact with one surface of the filtering device 213 on which the filtered out rubbish is placed. When the extension member 230 slides with respect to the dust collecting apparatus 210, the first rubbish removal portion 272 may slide in a state of being in close contact with the inner surface of the filtering device 213. Based on the sliding movement of the extension member 230 toward the inside of the dust collecting apparatus 210, the first rubbish removal portion 272 may remove rubbish such as hair tangled to the inner surface of the filtering device 213 by scratching the inner surface of the filtering device 213.

The first rubbish removal member 270 may move from a first position between the filtering device 213 and the rubbish separator 251, to a second position protruding to the outside of the dust collecting apparatus 210. Accordingly, the first rubbish removal member 270 may discharge the rubbish placed in the first dust chamber 210*a* to the outside. In addition, as the first rubbish removal member 270 protrudes to the outside of the dust collecting apparatus 210, dust collected in the second dust chamber 219 may also be discharged to the outside.

The extension member 230 may include a first connection portion 269 connecting the first rubbish removal member 270 to the opening and closing device 260. The first connection portion 269 may be arranged in the first dust chamber 210*a*. The first rubbish removal member 270 and the opening and closing device 260 may interlock with each other by the first connection portion 269.

A discharge opening 268 may be formed among the plurality of first connection portions 269. The discharge opening 268 may be formed between the first rubbish removal member 270 and the opening and closing device 260. When the opening and closing device 260 opens the first dust chamber 210*a* and the first dust removal member 270 discharges the rubbish of the first dust chamber 210*a*, the rubbish may be discharged to the outside through the discharge opening 268.

The extension member 230 may include the rubbish separator 251. The rubbish separator 251 may include a cyclone. The rubbish separator 251 may centrifuge the rubbish, which is not filtered out in the first dust chamber 210*a*, from air. Because the rubbish separator 251 separates the rubbish from air passing through the filtering device 213 in a different manner from the filtering device 213, the cleaner 2 according to another embodiment of the disclosure may increase cleaning efficiency.

The extension member 230 may include the second rubbish removal member 275 configured to discharge the rubbish of the second dust chamber 219. The second rubbish removal member 275 may be configured to slide in the second dust chamber 219 and the first dust chamber 210*a*. The second dust chamber 219 may be formed between the first rubbish removal member 270 and the second rubbish removal member 275. The second dust removal member 275 may include a second mounting portion 276 and a second rubbish removal portion 277 mounted on the second mounting portion 276.

The second rubbish removal portion 277 may be formed to include a material having elasticity. When the extension member 230 slides with respect to the dust collecting apparatus 210, the second rubbish removal portion 277 may slide in a state of being in close contact with the inner surface of the inner case 212 so as to discharge the rubbish of the second dust chamber 219. Based on the sliding movement of the extension member 230 with respect to the dust collecting apparatus 210, the second rubbish removal portion 277 may discharge all the rubbish of the second dust chamber 219 by sliding in state of being in close contact with the inner surface of the inner case 212.

The extension member 230 may include a second connection portion 279 connecting the first rubbish removal member 270 to the second rubbish removal member 275. The second connection portion 279 may be arranged in the second dust chamber 219. The second rubbish removal member 275 and the first rubbish removal member 270 may interlock with each other by the second connection portion 279.

The extension member 230 may include a rubbish guide 252 configured to guide the rubbish separated in the rubbish separator 251 to the second dust chamber 219. The rubbish guide 252 may be provided in a cone shape in which a radius thereof is reduced toward the second dust chamber 219.

The extension member 230 may include a fan motor case 241 slidably inserted into the inner case 212. The fan motor unit 240 and a motor filter 246 may be arranged in the fan motor case 241.

The motor filter 246 may be provided for filtering out rubbish contained in the air, which is before being introduced into the fan motor unit 240, again. The motor filter 246 may be arranged in front of the fan motor unit 240 in a direction in which air passing through the rubbish separator 251 is discharged through the discharge port 216. The motor filter 246 may be arranged between the fan motor unit 240 and the rubbish separator 251. The motor filter 246 may filter out the rubbish contained in the air passing through the rubbish separator 251. The motor filter 246 may be formed of a mesh member. The motor filter 246 may be arranged inside the outer case 211 while being mounted on the extension member 230. By using the motor filter 246, the cleaner 2 according to another embodiment of the disclosure may prevent the fan motor unit 240 from being damaged by the rubbish and thus the cleaner 2 may discharge relatively clean air through the discharge port 216.

The fan motor unit 240 may be configured to supply a suction force to the first dust chamber 210*a* and the second dust chamber 219. The air passing through the motor filter 246 may move to a discharge member 242 after passing through the fan motor unit 240. The fan motor unit 240 may be arranged closer to the opening and closing device 260 than the handle 233. The fan motor unit 240 may be arranged at a relatively lower side of the extension member 230. As for the cleaner 2 according to another embodiment of the disclosure, the fan motor unit 240 that is relatively heavy than the battery 203*a* may be positioned below the battery 203*a*, and thus the center of gravity may be positioned relatively downward. Accordingly, the cleaner 2 according to another embodiment of the disclosure may have a relatively lower center of gravity and thus the convenience of use may be increased.

The discharge member 242 may be provided to communicate with the discharge port 216. Air introduced into the discharge member 242 through the fan motor unit 240 may be guided to the discharge port 216 by the discharge member 242.

The cleaner 2 according to another embodiment of the disclosure may be provided such that the inside of the fan motor case 241 of the extension member 230 in which the fan motor unit 240 is arranged is separated from the battery mounting portion 236. That is, the air flowing by the fan motor unit 240 is immediately discharged through the discharge port 216 without moving to the battery mounting portion 236 and the handle 233. Accordingly, the cleaner 2 according to another embodiment of the disclosure may minimize the amount of air discharged toward the user.

According to the above-described configuration, when the cleaner 2 according to another embodiment of the disclosure performs the cleaning operation, the air containing the rubbish introduced from the suction head 30 may be firstly filtered by the filtering device 213 of the first dust chamber 210*a*. Thereafter, the air moved to the dust/rubbish separator 251 through the case flow path 210*b* may be secondly filtered. The air filtered by the dust/rubbish separator 251 may be collected in the second dust chamber 219. The air passing through the dust/rubbish separator 251 may be thirdly filtered by passing through the motor filter 246 and then the filtered air may pass through the fan motor unit 240. The air passing through the fan motor unit 240 may be discharged to the discharge port 216 through the discharge member 242.

Figure 14:
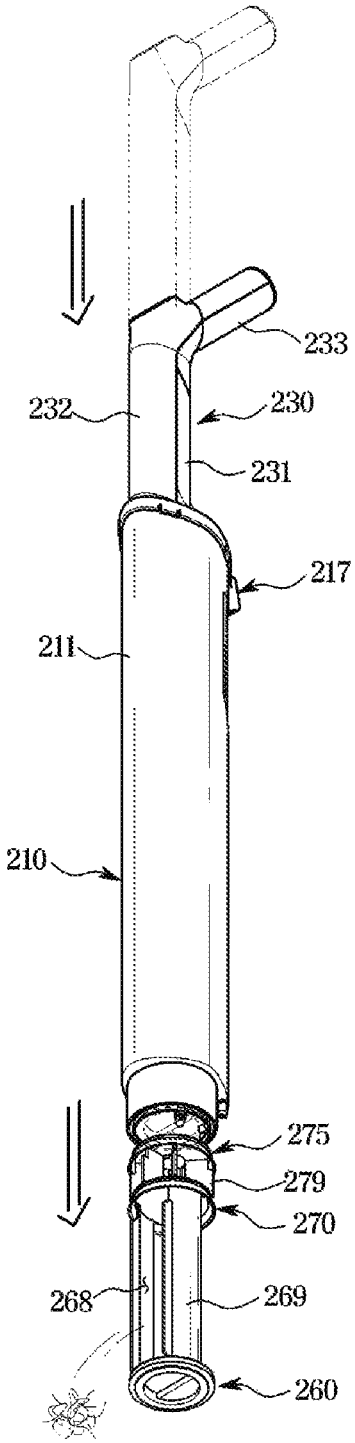
FIG. 14 is a view illustrating a state in which dust of the dust collecting apparatus of the cleaner of FIG. 9 is discharged according to an embodiment of the disclosure.

FIG. 14 is a view illustrating a state in which dust of the dust collecting apparatus of the cleaner of FIG. 1 is discharged according to an embodiment of the disclosure.

Figure 15:
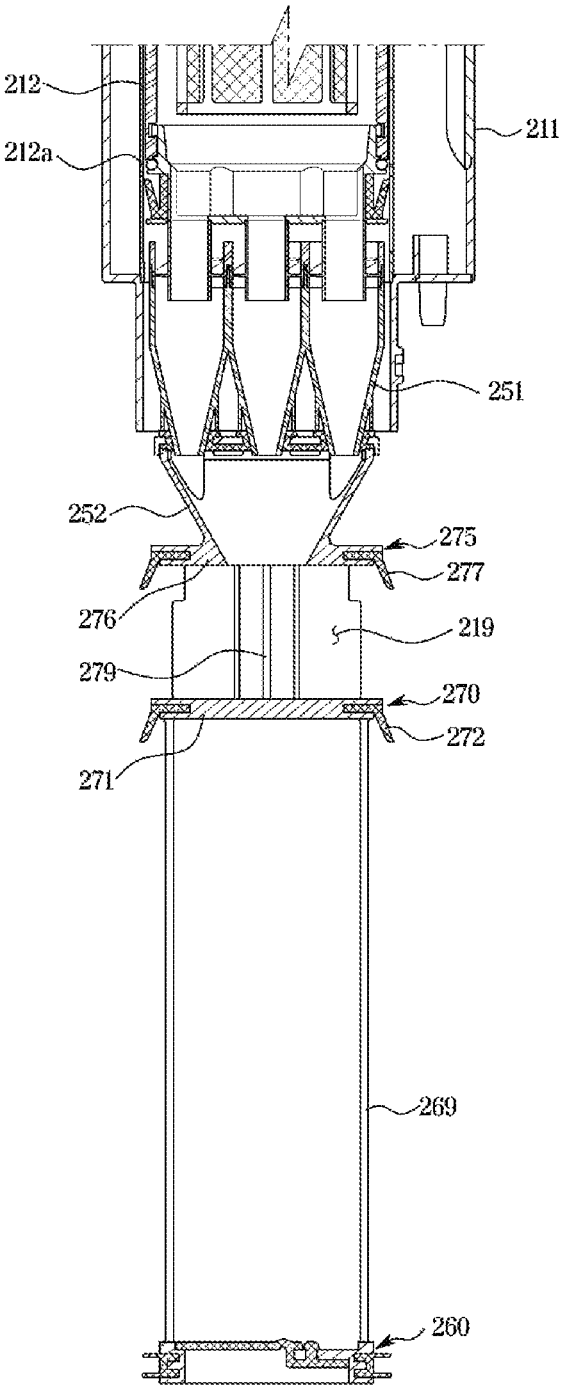
FIG. 15 is a cross-sectional view of a portion of the cleaner of FIG. 14 according to an embodiment of the disclosure.

FIG. 15 is a cross-sectional view of a portion of the cleaner of FIG. 14 according to an embodiment of the disclosure.

Figure 16:
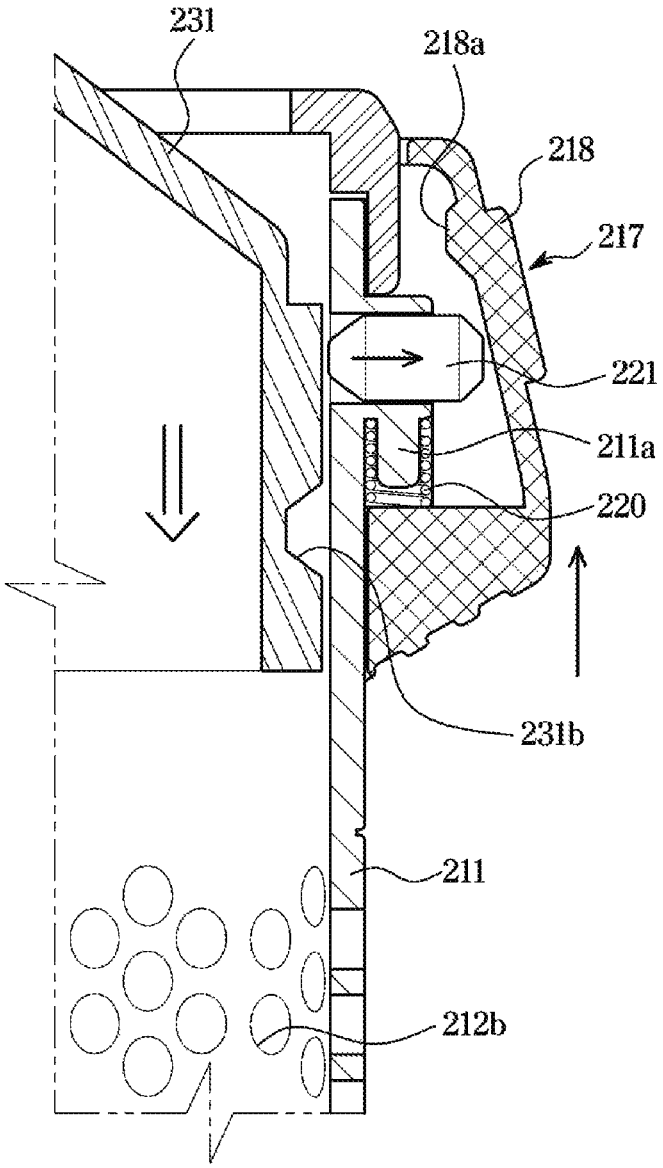
FIG. 16 is a cross-sectional view of a button device of the cleaner of in FIG. 14 according to an embodiment of the disclosure.

FIG. 16 is a cross-sectional view of a button device of the cleaner of in FIG. 14 according to an embodiment of the disclosure.

Referring to FIGS. 14 and 15, when a user intends to discharge dust collected in the dust collecting apparatus 210 after finishing the cleaning operation, the user may slide the extension member 230 with respect to the dust collecting apparatus 210 by applying a force to the extension member 230. In this case, the user may move the button 218 for moving the extension member 230.

Referring to FIGS. 13 to 16, the button device 217 may include a button 218, a fixing member 221 and an elastic member 220.

The button 218 may be arranged on an outer wall of the dust collecting apparatus 210. The button 218 may be located at the rear surface of the dust collecting apparatus 210. The button 218 may be configured to be movable with respect to the dust collecting apparatus 210. When a user intends to remove dust inside the dust collecting apparatus 210 by sliding the extension member 230 with respect to the dust collecting apparatus 210, the user may press and move the button 218. The button 218 may include a pressing portion 218*a* configured to press the fixing member 221 to allow the fixing member 221 to be inserted into an insertion groove 231*b* of the extension case 231 of the extension member 230.

The button 218 may be elastically biased to a position for pressing the fixing member 221 by the elastic member 220. Therefore, after the dust inside the dust collecting apparatus 210 is discharged, the extension member 230 may slide in the direction to be moved out with respect to the dust collecting apparatus 210 and thus the fixing member 221 is inserted into the insertion groove 231*b* again. In this case, the button 218 may return to its original position by the elastic member 220.

The fixing member 221 may fix the extension member 230 to the dust collecting apparatus 210 or release the fixation between the extension member 230 and the dust collecting apparatus 210 according to the movement of the button 218. The fixing member 221 may be insertable into the insertion groove 231*b* of the extension case 231.

The elastic member 220 may elastically bias the button 218 to a fixed position to fix the extension member 230 to the dust collecting apparatus 210. One end of the elastic member 220 may be fixed to a button fixing portion 211*a* of the outer case 211, and the other end thereof may be fixed to the button 218.

According to the movement of the button 218, a space, in which the fixing member 221 moves, is formed in the button 218. In this state, when a user applies a force to the extension member 230, the fixing member 221 is separated from the insertion groove 231*b* and moves toward the button 218. As a result, the extension member 230 may slide into the dust collecting apparatus 210.

When the extending member 230 slides inside the dust collecting apparatus 210, the opening and closing device 260 arranged at one end of the extending member 230 opens the first dust chamber 210*a*, the first rubbish removal member 270 slides in one surface on which the rubbish of the filtering device 213 is placed, and the second rubbish removal member 275 slides in the inner surface of the second dust chamber 219 and one surface of the filtering device 213 in which the rubbish is placed. The first rubbish removal member 270 may separate the rubbish placed in the filtering device 213 and discharge the rubbish to the outside of the first dust chamber 210*a*. The second rubbish removal member 275 discharges the rubbish of the second dust chamber 219 to the outside and at the same time the second rubbish removal member 275 may secondly separate the rubbish placed in the filtering device 213 and discharge the separated rubbish to the outside of the first dust chamber 210*a*.

To this end, the first rubbish removal member 270 and the second rubbish removal member 275 may move to a position protruding to the outside of the dust collecting apparatus 210. Further, the extension member 230 may move to expose only the opening and closing device 260 to the outside of the dust collecting apparatus 210 without exposing the first rubbish removal member 270 and the second rubbish removal member 275 to the outside of the dust collecting apparatus 210. Alternatively, the extension member 230 may move to expose only the opening and closing device 260 and the first rubbish removal member 270 to the outside of the dust collecting apparatus 210 without exposing the second rubbish removal member 275 to the outside of the dust collecting apparatus 210.

When discharging of the dust in the dust chamber 210*a* and 219 is completed, a user can move the extension member 230 in the direction to be moved out from the dust collecting apparatus 210. Accordingly, the opening and closing device 260 moves to a position for closing the first dust chamber 210*a*. In addition, the button 218 is moved by the elastic member 220 and presses the fixing member 221 to be inserted into the insertion groove 231*b*. Therefore, the position of the extension member 230 with respect to the dust collecting apparatus 210 is fixed.

According to this configuration, the cleaner 2 according to another embodiment of the disclosure may easily discharge the rubbish of the dust collecting apparatus 210 through a relatively simple operation. In addition, because the opening and closing device 260 is configured to open and close the dust chambers 210*a* and 219 only when the dust of the dust collecting apparatus 210 is discharged, it is possible to prevent the rubbish from scattering even when the dust collecting apparatus 210 is separated from the suction head 30.

As is apparent from the above description, because the cleaner slides the handle with respect to the dust collecting apparatus, the rubbish removal member connected to the handle may separate the rubbish attached to one side of the filtering device and thus the cleaner may easily discharge the rubbish collected in the dust collecting apparatus.

Further, the dust chamber is opened when the dust removal member protrudes out of the dust collecting apparatus by sliding the handle after separating the dust collecting apparatus from the transfer device. Therefore, it is possible to prevent the rubbish from scattering when emptying the dust chamber.

Because only the handle for sliding the rubbish removal member is exposed to the outside of the dust collecting apparatus, the cleaner may prevent the remaining rubbish from being exposed to the user, which may occur due to the sliding movement of the rubbish removal member.

The size of the cleaner may be reduced because the cleaner has a relatively simple configuration and a portion of the link is positioned inside the housing.

The cleaner may have a relatively lower center of gravity and thus convenience of use may be improved.

Because the opening and closing member for opening and closing the dust chamber is operated together with the rubbish removal member, the cleaner may prevent the dust chamber from being inadvertently opened.

While the disclosure has been shown and described with reference to various embodiments thereof, it would be understood by those skilled in the art that various changes in form and details may be made therein without departing from the spirit and scope of the disclosure as defined by the appended claims and their equivalents.

What is claimed is:

1. A cleaner comprising:

a suction head;

a dust collector having one end mounted on the suction head, and configured to form a dust chamber to collect rubbish introduced through the suction head; and an extension member slidably coupled to the dust collector, wherein the extension member comprises:

a rubbish remover configured to be slidable along an extension direction of the extension member in the dust chamber and configured to discharge the rubbish of the dust chamber to an outside of the dust collector, an opening and closing frame disposed on an end of the extension member facing the suction head, the opening and closing frame configured to interlock with the rubbish remover and to be slidable along the extension direction of the extension member in order to open and close the dust chamber, wherein the opening and closing frame comprises a chamber inlet formed to allow air introduced from the suction head to flow into the dust chamber.

2. The cleaner of claim 1, wherein the opening and closing frame further comprises:

an opening and closing member in which the chamber inlet is formed; and an opening and closing cover configured to open and close the chamber inlet by a suction force formed in the dust chamber.

3. The cleaner of claim 2, wherein one portion of the opening and closing cover is fixed to the opening and closing member, and another portion different from the one portion is deformable by the suction force formed in the dust chamber.

4. The cleaner of claim 2, wherein the opening and closing frame further comprises a portion configured to seal between the dust collector and the opening and closing member and arranged along an edge of the opening and closing member.

5. The cleaner of claim 4, wherein the portion of the opening and closing frame is formed to include a more flexible material than the opening and closing member.

6. The cleaner of claim 1, wherein the extension member further comprises:

a connector configured to connect the rubbish remover to the opening and closing frame, and a discharge opening formed between the rubbish remover and the opening and closing frame and configured to discharge the rubbish of the dust chamber.

7. The cleaner of claim 1, wherein the opening and closing frame moves away from the dust collector to open the dust chamber when the rubbish remover slides to be moved out of the dust chamber, and wherein the opening and closing frame moves closer to the dust collector to close the dust chamber when the rubbish remover slides to be inserted into the dust chamber.

8. The cleaner of claim 1, wherein the extension member further comprises a handle arranged at an opposite end to the end of the extension member in which the opening and closing frame is arranged; and a fan motor unit configured to generate a suction force for the dust chamber and arranged between the opening and closing frame and the handle.

9. The cleaner of claim 8, further comprising:

a battery arranged between the handle and the fan motor unit of the extension member.

10. The cleaner of claim 8, wherein the dust collector further comprises a discharge port formed at a portion of a rear surface thereof corresponding to a position of the fan motor unit in a state in which the opening and closing frame closes the dust chamber.

11. The cleaner of claim 8, further comprising:

a motor filter configured to filter air introduced to the fan motor unit, wherein the motor filter is arranged between the fan motor unit and the dust chamber.

12. The cleaner of claim 1, further comprising:

a filter arranged in the dust chamber of the dust collector and configured to filter out the rubbish introduced through the suction head, and wherein when the extension member slides with respect to the dust collector, the rubbish remover is slidable along one surface of the filter on which the filtered out rubbish is placed.

13. The cleaner of claim 1, wherein the dust chamber is a first dust chamber, wherein the extension member further comprises a cyclone configured to remove the rubbish from air passing through the first dust chamber, and wherein the dust collector comprises a second dust chamber in which the rubbish separated by the cyclone is collected.

14. The cleaner of claim 13, wherein the rubbish remover is a first rubbish remover, and wherein the extension member further comprises a second rubbish remover configured to be slidable along the second dust chamber and the first dust chamber to discharge the rubbish of the second dust chamber based on a sliding movement of the extension member with respect to the dust collector.

* * * * *